US010710092B2

(12) United States Patent
Meeuwsen et al.

(10) Patent No.: US 10,710,092 B2
(45) Date of Patent: Jul. 14, 2020

(54) DISCHARGE GRATES FOR REDUCTION MILLS

(71) Applicant: ESCO Corporation, Portland, OR (US)

(72) Inventors: Kyle J. Meeuwsen, Portland, OR (US); Casey E. Springer, Portland, OR (US); Michael R. Weeks, Portland, OR (US)

(73) Assignee: ESCO GROUP LLC, Portland, OR (US)

( * ) Notice: Subject to any disclaimer, the term of this patent is extended or adjusted under 35 U.S.C. 154(b) by 918 days.

(21) Appl. No.: 14/798,373

(22) Filed: Jul. 13, 2015

(65) Prior Publication Data

US 2016/0008819 A1 Jan. 14, 2016

Related U.S. Application Data

(60) Provisional application No. 62/024,038, filed on Jul. 14, 2014.

(51) Int. Cl.
*B02C 13/284* (2006.01)
*B02C 13/04* (2006.01)

(52) U.S. Cl.
CPC ..... *B02C 13/284* (2013.01); *B02C 13/04* (2013.01)

(58) Field of Classification Search
CPC ..... B02C 13/284; B02C 13/04
See application file for complete search history.

(56) References Cited

U.S. PATENT DOCUMENTS

| | | | | |
|---|---|---|---|---|
| 110,351 | A | | 12/1870 | Follet |
| 141,917 | A | | 8/1873 | Carpenter |
| 190,180 | A | | 5/1877 | Bailey |
| 744,864 | A | * | 11/1903 | Houghton ..... D01G 9/20 19/95 |
| 750,167 | A | | 1/1904 | Clement |
| 763,639 | A | | 6/1904 | Schoellhorn et al. |
| 870,731 | A | | 11/1907 | Landis |
| 882,896 | A | * | 3/1908 | Landis ..... A01F 12/24 460/110 |
| 934,106 | A | | 9/1909 | Storer |
| 1,021,906 | A | | 4/1912 | Tomlinson |
| 1,125,137 | A | * | 1/1915 | Liggett ..... B02C 13/282 241/286 |
| 1,424,923 | A | | 8/1922 | Knittel |
| 1,524,909 | A | | 2/1925 | Buchan |
| 1,571,675 | A | | 2/1926 | Knight |
| 2,128,194 | A | | 8/1938 | Sheldon |
| 2,215,226 | A | * | 9/1940 | Meyer ..... B02C 13/282 209/393 |
| 2,317,909 | A | | 4/1943 | Gruendler |
| 2,463,223 | A | | 3/1949 | Verch |
| 2,666,589 | A | | 1/1954 | Danyluke |
| 3,254,687 | A | | 6/1966 | Alexandrovich |

(Continued)

FOREIGN PATENT DOCUMENTS

| | | |
|---|---|---|
| EP | 0499154 | 8/1992 |
| GB | 2176131 | 12/1986 |

(Continued)

*Primary Examiner* — Omar Flores Sanchez
(74) *Attorney, Agent, or Firm* — Steven Schad; Palmer Dzurella

(57) ABSTRACT

Discharge grate components for reducing machines including stops to inhibit pokers within the grate so that the pokers are not ejected from the grate with a high velocity.

36 Claims, 18 Drawing Sheets

(56) References Cited

U.S. PATENT DOCUMENTS

| | | | |
|---|---|---|---|
| 3,716,060 | A | 2/1973 | Suzue |
| RE28,368 | E | 3/1975 | Bonarrigo |
| 4,009,836 | A | 3/1977 | Strom et al. |
| 4,226,375 | A | 10/1980 | Cameron |
| 4,597,538 | A | 7/1986 | Getz |
| 4,634,525 | A | 1/1987 | Yant |
| 4,776,375 | A | 10/1988 | Arasmith |
| 4,802,631 | A | 2/1989 | Arasmith |
| 4,874,024 | A | 10/1989 | Arasmith |
| 4,934,614 | A | 6/1990 | Lewis |
| 4,982,904 | A | 1/1991 | Greiner |
| 5,018,674 | A | 5/1991 | Williams |
| 5,503,338 | A | 4/1996 | Thom, Jr. |
| 5,526,988 | A | 6/1996 | Rine |
| 5,570,849 | A | 11/1996 | Anderson |
| 6,196,284 | B1 | 3/2001 | Lequin |
| 6,530,483 | B2 | 3/2003 | Schulte et al. |

FOREIGN PATENT DOCUMENTS

| | | |
|---|---|---|
| JP | 03032755 | 10/1996 |
| WO | WO 2012/069222 | 5/2012 |
| WO | WO 2012/152996 | 11/2012 |

* cited by examiner

DISCHARGE GRATES FOR REDUCTION MILLS

RELATED APPLICATION

This application claims priority benefits to U.S. Provisional Application No. 62/024,038 filed Jul. 14, 2014 which is incorporated herein by reference in its entirety.

FIELD OF THE INVENTION

The present invention relates generally to reduction mills, such as crushers, grinders, shredders, pulverizers, and the like, that reduce materials to relatively small fragments to facilitate handling and subsequent processing. More particular aspects of this invention relate to discharge grate baskets and discharge grate components or panels for reduction mills.

BACKGROUND OF THE INVENTION

Industrial shredding equipment is known and used, for example, in the recycling industry, to break apart large objects into smaller pieces that can be more readily processed. In addition to shredding material like rubber (e.g., car tires), wood, and paper, commercial shredding systems are available that can shred large ferrous materials, such as scrap metal, automobiles, automobile body parts, and the like.

FIG. 1A generally illustrates an example shredding system 100 as is known and in use in the art, and FIG. 1B illustrates a more detailed view of a conventional shredding head or rotors that may be used in such a shredding system. More specifically, as shown in FIG. 1A, this example shredding system 100 includes a material inlet system (such as chute 102) that introduces the material 104 to be shredded to the shredding chamber 106. The material 104 to be shredded may be of any desired size or shape, and, if desired, it may be heated, cooled, crushed, baled, or otherwise pretreated prior to introduction into the shredding chamber 106. If necessary or desired, the inlet system 102 may include feed rollers or other machinery to help push or control the rate at which the material 104 enters into the chamber 106, to help hold the material 104 against an anvil 108, and/or to help keep the material 104 from moving backward up the chute 102. A disc rotor is shown. However, other rotors, such as spider and barrel, are also commonly used and this invention may be equally useful with those types of rotors.

A rotary shredding head 110 (rotatable about axis or shaft 110A) is mounted in the shredding chamber 106. As the head 110 rotates, the shredding hammers 112 extend outward and away from the rotational axis 110A of the head 110 due to centrifugal force (as shown in FIG. 1A). As they rotate, the shredder hammers 112 impact the material 104 to be shredded between the hammer 112 and the anvil 108 (or other hardened surface provided within the shredding system 100) in order to break apart the material 104 with blunt impact forces. The construction of one conventional shredding head 110 will be described in more detail below in conjunction with FIG. 1B. As the material 104 is shredded, it may be discharged from the shredding chamber 106 through one of the outlets 114*a* provided in a discharge grate basket 114 located along the bottom and side of the chamber 106 walls, and transported in some manner (generally shown by arrows 116, such as via gravity, via conveyors, via truck or other vehicle, etc.) for further processing (e.g., further recycling, reclamation, separation, or other processing).

FIG. 1B provides a more detailed view of an example shredding head 110 that may be used in the shredding system 100 of FIG. 1A. This example shredding head 110 is made from multiple rotor disks 120 that are separated from one another by spacers 122 mounted around the drive shaft 110A. While any number of rotor disks 120 may be provided in a shredding head 110 (e.g., 8-16), this illustrated example includes seven disks 120 (the end disk 120 is omitted from FIG. 1B to better show the details of the underlying structures). The disks 120 may be fixedly mounted with respect to the shaft 110A (e.g., by welding, mechanical connectors, etc.) to allow the disks 120 to be rotated when the shaft 110A is rotated (e.g., by an external motor or other power source, not shown). In addition to providing a spacing function, spacers 122 can help protect the shaft 110A from undesired damage, e.g., due to contact with material 104 being shredded, broken parts of a shredder hammer 112, etc.

Hammer pins 124 extend between at least some of the rotor disks 120 (more commonly, between several disks 120 and/or through the entire length of the head 110), and the shredder hammers 112 are rotatably mounted on and are rotatable with respect to these pins 124. More specifically, as shown in FIG. 1B, a hammer pin 124 extends through an opening 112A provided in the mounting portion 112F of the shredder hammer 112, and the shredder hammer 112 is capable of rotating around this pin 124. In this illustrated example, the shredding head 110 includes six hammer pins 124 around the circumference of the rotor disks 120. A single shredder hammer 112 is provided on each pin 124 between two adjacent rotor disks 120 such that each hammer pin 124 includes a single shredder hammer 112 mounted thereon and the shredder hammers 112 are staggered along the longitudinal length of the head 110. This hammer pattern may be modified as required by the end user, depending on their needs. At locations between rotor disks 120 where no shredder hammer 112 is provided on a particular hammer pin 124, the pin 124 may be covered with a pin protector 126, to protect the pin structure 124 from contact with and damage caused by the material 104 being shredded. These pin protectors 126 may be of any desired size and/or shape.

In use, the rotor disks 120 are rotated as a unit with shaft 110A, e.g., by an external motor or other power source (not shown). The centrifugal force associated with this rotation causes the shredder hammers 112 to rotate about their respective pins 124 to extend their heavier blade ends 112E outward and away from the shaft 110A, as shown in FIG. 1A. As the rotation continues, the shredder hammer 112 will contact the material 104 to be shredded. Because the hammers are rotatably mounted on the hammer pins 124, contact with the material 104 to be shredded may cause the shredder hammers 112 to slow down or even rotate in the opposite direction as they smash the material 104 to be shredded against the anvil 108. The pins 124, pin protectors 126, hammers 112, spacers 122, and rotor disks 120 may be structured and arranged so that, in the event that a shredder hammer 112 is unable to completely pass through the material 104, it can rotate to a location between adjacent plates 120 and thereby pass by the material 104 until it is able to extend outward again under the centrifugal force due to rotation of the shredder head 110 about shaft 110A for the next collision. Also, in some instances, the shredder hammer 112 will shift sideways on its pin 124 as it passes by or through the material to be shredded. If desired, the various parts of the shredder head 110 may be shaped and oriented with respect to one another such that a shredder hammer 112 can rotate 360° around its pin 124 without contacting another pin 124, a pin protector 126, the drive shaft 110A, another hammer 112, etc. Shredding systems and heads of the types described above are known and used in the art.

Thus, as described above, the reduction (e.g., shredding) is achieved by introducing the material 104 to be shredded into the path of the rotating hammers 112 (located within a drum or housing), and the accompanying impact with the hammers 112 alone is enough to achieve at least partial reduction. Further reduction may occur as the hammers 112 force the material 104 across and through the discharge grate basket 114. The discharge grate basket 114 is webbed or has a sieve-like structure including a plurality of discharge openings 114*a*. The openings 114*a* in grate basket 114 can be of any pattern, but conventionally the openings 114*a* are aligned in both circumferential and axial rows. When the reduced fragments of input material are small enough, they pass through the grate openings 114*a* and leave the machine. The discharge grate basket 114 has a high wear rate and, as a sacrificial component, has to be replaced frequently. The discharge grate basket 114, however, does not wear as fast as the hammers 112, which must be replaced more frequently.

Features of conventional or known discharge grate basket 114 will be described in more detail in conjunction with FIGS. 1C through 1L. As shown in FIG. 1C, the bottom and side portions of this example discharge grate basket 114 (e.g., extending approximately 80° to 250° around the circle defined by rotary motion of the shredder head 110) are made from a plurality of separate discharge grate components 130 aligned around a portion of the circumference of the circle. Five individual discharge grate components 130 are shown in the example of FIG. 1C. The discharge grate components 130 include a structure that engages with a corresponding structure provided on a mounting frame 132, e.g., associated with the shredder housing, drum, or other reduction machine, to mount the discharge grate components on the frame 132. The discharge grate components 130 are individually abutted against the mounting frame 132 and slid (or otherwise moved) along the frame rails to the desired location in the overall discharge grate basket 114 (e.g., using a crane or other lifting equipment).

FIGS. 1D through 1J show various views of an individual discharge grate component 130, including a bottom perspective view (FIG. 1D), a top perspective view (FIG. 1E), a top view (FIG. 1F), an end view (FIG. 1G), a front view (FIG. 1H), and cross sectional views (FIGS. 1I and 1J) taken along line B-B in FIG. 1H. As shown in these figures, this discharge grate component 130 includes two longitudinally oriented grate elements 136*a* and 136*b* with a plurality of transverse grate elements 134 extending between the longitudinal grate elements 136*a* and 136*b*. The grate discharge openings 114*a* are defined between the longitudinal grate elements 136*a* and 136*b* and the transverse grate elements 134 to provide the sieve or webbing structure to the interior working surface 134S of the grate component 130 (see FIG. 1E). The outer sides of longitudinal grate elements 136*a* and 136*b* include portions of transverse grate elements 134 that will be used to form portions of grate discharge openings 114*a* with adjacent discharge grate components 130 when the plurality of grate discharge components 130 are mounted around the mounting frame 132.

As shown in these figures, longitudinal support beams 138*a*, 138*b* are provided in this grate component structure 130 as integral extensions of the longitudinal grate elements 136*a*, 136*b*, respectively, that form edges of the grate discharge openings 114*a*. The longitudinal support beams 138*a*, 138*b* in this illustrated example have an arched structure that extends outward (away from working surface 134S) and has greater height at the center of the longitudinal direction as compared to its height at the edges (near ends 140). This feature provides support against deformation and bending at the longitudinal center area. The frames 132 at the longitudinal ends 140 of the grate component 130 help provide additional support against deformation and bending at locations near the ends 140. Because of the presence of longitudinal support beams 138*a*, 138*b*, as perhaps best shown in FIG. 1D, the longitudinal grate elements 136*a*, 136*b* extend outward (and away from working surface 134S) beyond the outer surfaces 134*a* of the transverse grate elements 134 in this structure 130. At least one of the longitudinal support beams (138*a*, in this illustrated example) may include one or more handle elements 142 to better enable lifting and handling of the grate component 130, e.g., by a crane. Longitudinal support beam shapes other than arched are possible, such as rectangular or trapezoidal shapes.

As shown in FIG. 1I, the discharge opening 114*a* is oriented at an angle $\alpha$ with respect to a direction normal N to the interior working surface 134S of the webbing structure defined by the longitudinal grate elements 136*a* and 136*b* and the transverse grate elements 134. In conventional discharge grate components 130, this angle $\alpha$ is typically within a range of about 0° to 30°. The discharge angle helps better accept the reduced material within discharge opening 114*a* as the material is moving under the rotary force of the rotating hammer structure. Notably, however, for discharge grate components 130 located more on the side areas of the grate basket (e.g., area S shown in FIG. 1C), the extended longitudinal support beams 138*a*, 138*b* can provide a relatively long shelf on which discharged materials can get hung up during operation of the reducing equipment. This hang-up problem is further exacerbated by the solid construction of the support beams 138*a*, 138*b*.

The longitudinal support beams 138*a*, 138*b* oppose the direct force of the hammer 112 impacts and incorporate a substantial support structure to counter these impact loads. The support beams 138*a*, 138*b* constitute a significant portion of the mass of the grate component 130. As illustrated in FIG. 1J, however, because of the desired discharge angle $\alpha$ and the fact that the longitudinal support beams 138*a*, 138*b* are integrally formed extensions of the longitudinal grate elements 136*a*, 136*b*, the direction of greatest grate strength of the longitudinal support beams 138*a*, 138*b* (shown by arrows 144 in FIG. 1J) is angled from the direction of impact force from the hammers (shown by arrows 146 in FIG. 1J, e.g., in a direction normal to the interior working surface 134S of the grate component structure 130). If these directions 144, 146 get further away from alignment (i.e., if angle $\beta$ gets too large), this may lead to distortion or deflection of the grate component 130 and/or even to failure of the grate component 130. Distortion or deflection of the grate components 130 can lead to decreased performance due to decreased impact energy imparted by the hammers to the scrap and/or difficulty in removal of these components from the frame (e.g., increasing the need to trim or cut the grate to remove it from the mill). In an effort to combat distortion, deflection, or breakage, the longitudinal support beams 138*a*, 138*b* are made with the arched structure as described above, and at an angle of no more than about 30 degrees.

As is evident from the above description, grate components 130 are exposed to extremely harsh conditions of use. Thus, grate components 130 typically are constructed from hardened steel materials, such as low alloy steel or high manganese alloy content steel (such as Hadfield Manganese Steel, containing about 11 to 14% manganese, by weight). Such materials are known and used in the art. Even when such hardened materials are used, however, the surface 134S of the grate components 130 facing the hammers 112 wears significantly and the grate components 130 are replaced on a regular basis to maintain production rates. The balance of the grate components 130 (e.g., the outer surfaces and structures, including beam supports 138*a*, 138*b*) experience much less wear and serve as support structures that are subsequently scrapped when the interior working surface 134S becomes excessively worn.

As noted above, the hammers 112 rotate with sufficient speed to break up the material 104 with blunt impact forces. However, occasionally the blunt impact forces cause a long bar-like piece of scrap (i.e., a poker 104*a*) to be ejected through the discharge opening 114A (FIG. 1K). If a poker 104A exits the discharge opening 114A with a high enough velocity it may puncture or otherwise damage other components of the recycling system 100 (e.g., the shredder's shaker table or conveyor 115). If a poker damages the conveyor 115 or other components of the recycling system 100, the shredder must be stopped and the damage repaired.

There is the highest potential for pokers 104A to be ejected through the grates that are closest to the anvil 108. In an effort to minimize the damage done by pokers 104A, solid grates 130A with no discharge openings 114A are occasionally installed in the area T adjacent the inlet 102 (FIG. 1L). While the solid grates are generally effective at preventing pokers 104A from damaging other components of the recycling system 100, the solid grates 130A contribute significantly more weight to the assembly per square inch of coverage than grates 130. In addition the solid grates 130A reduce the potential for material throughput through the system.

Accordingly, there is room in the art for improvements in the structure and construction of grates for reducing equipment.

SUMMARY OF THE INVENTION

This invention relates to discharge grate components, discharge grate baskets including such discharge grate components, and shredding or other reducing machines including such discharge grate baskets and discharge grate components.

In accordance with one aspect of the invention, a discharge grate component for use in a reduction mill (e.g., a shredding machine) includes intersecting members to define a grate structure, and at least one support outward of the grate structure along one intersecting member such that a substantial portion of the support is upstream of the intersecting member.

In accordance with one other aspect of the invention, a discharge grate component includes intersecting members to define a grate structure, and at least one support extending outward of the grate structure in at least partially a curved configuration.

In accordance with one other aspect of the invention, a discharge grate component includes at least one longitudinal grate element, a plurality of transverse grate elements to provide discharge openings through the grate component, and at least one longitudinal support beam to resist bending and deflection of the overall discharge grate component. The at least one said longitudinal grate element and the plurality of transverse grate elements have an interior working surface defining a wear surface across which material to be shredded traverses. The discharge grate component has a stop so that there is minimal to no straight line of path through the discharge openings. The stop inhibits pokers within the grate so that the pokers are not ejected from the grate with a high velocity. The stop protrudes in directions which may include a direction opposite the direction of the material flow over the grate. In one preferred construction, the stop is an integral part of the longitudinal grate element. In another preferred construction, the stop is an integral part of the longitudinal grate element and the longitudinal support beam.

In accordance with another aspect of the invention, the stop is curved in directions that may include a direction opposite the direction of the material flow over the grate. In one preferred construction, the stop is continuously curved as it extends away from the discharge openings.

In accordance with another aspect of the invention, the discharge openings have a width in the direction of the material flow over the grate, and the stop has a depth that it extends outward of the discharge openings, wherein the width of the discharge openings to the depth of the stop has a ratio of less than 0.95 (i.e., width/depth<0.95). In one preferred construction, the width to depth ratio is less than or equal to 0.6.

In accordance with another aspect of the invention, the at least one said longitudinal support beam extends outward of the grate openings and has an upstream surface that is arcuate as the surfaces extends away from the discharge openings such that the surface curves upstream, i.e., in a direction opposite the direction of material flow over the grate.

In one preferred construction, the at least one said longitudinal support beam extends outward of the at least one said longitudinal grate element, and is curved in a direction opposite the direction of the material flow (i.e., upstream) to minimize the risk of pokers damaging conveyors or other equipment, and the amount of material that will be caught on the longitudinal support beam when installed in a position between approximately 30 degrees and 180 degrees relative to the material inlet in a direction of the movement of the rotational axis of the head (i.e., in a position between approximately the 3 and 8 o'clock positions in the shredding system). In another preferred construction the grate component is installed in a position between approximately 60 degrees and 120 degrees relative to the material inlet in a direction of the movement of the rotational axis of the head (i.e., in a position between approximately the 5 and 7 o'clock positions in the shredding system).

In accordance with another aspect of the invention, the grate component has a longitudinal support beam that extends forward of the leading edge of the interior working surface of the grate component.

In accordance with another aspect of the invention, the discharge grate opening defines at least a portion of a stop to minimize the risk of pokers damaging conveyors or other equipment.

Other aspects, advantages, and features of the invention will be described in more detail below and will be recognizable from the following detailed description of example structures in accordance with this invention.

BRIEF DESCRIPTION OF THE DRAWINGS

The present invention is illustrated by way of example and not limited in the accompanying figures, in which like reference numerals indicate the same or similar elements throughout, and in which.

The reader is advised that the various parts shown in these drawings are not necessarily drawn to scale.

DETAILED DESCRIPTION OF THE PREFERRED EMBODIMENTS

The following description and the accompanying figures disclose example features of reducing equipment structures, discharge grate baskets, and individual components of those grate baskets in accordance with the present invention.

The terms "longitudinal," "transverse," "axial," "radial," and the like are used in this specification to describe various angular orientations, directions, and/or features of structures according to the invention. Structures in accordance with this invention may be used in conjunction with a shredder head that rotates around a central axis of rotation. The terms "longitudinal" and "axial" as used herein refer to a direction that is generally parallel to the axis of rotation of the head of the shredding or reducing machine. An element may be straight or curved and still extend in the "longitudinal" or "axial" directions. The term "transverse" as used herein refers to a direction that is generally parallel to the circular or circumferential direction defined by rotation of the head. An element may be straight or curved around the circumferential direction and still extend the "transverse" direction. A "transverse" element need not be oriented at 90° from a "longitudinal" or "axial" element at any or all locations, although it may be oriented at a 90° angle at least at some portions. The term "radial" as used herein refers to a direction generally extending 90° from the axis of rotation of the head.

Figure 1A:
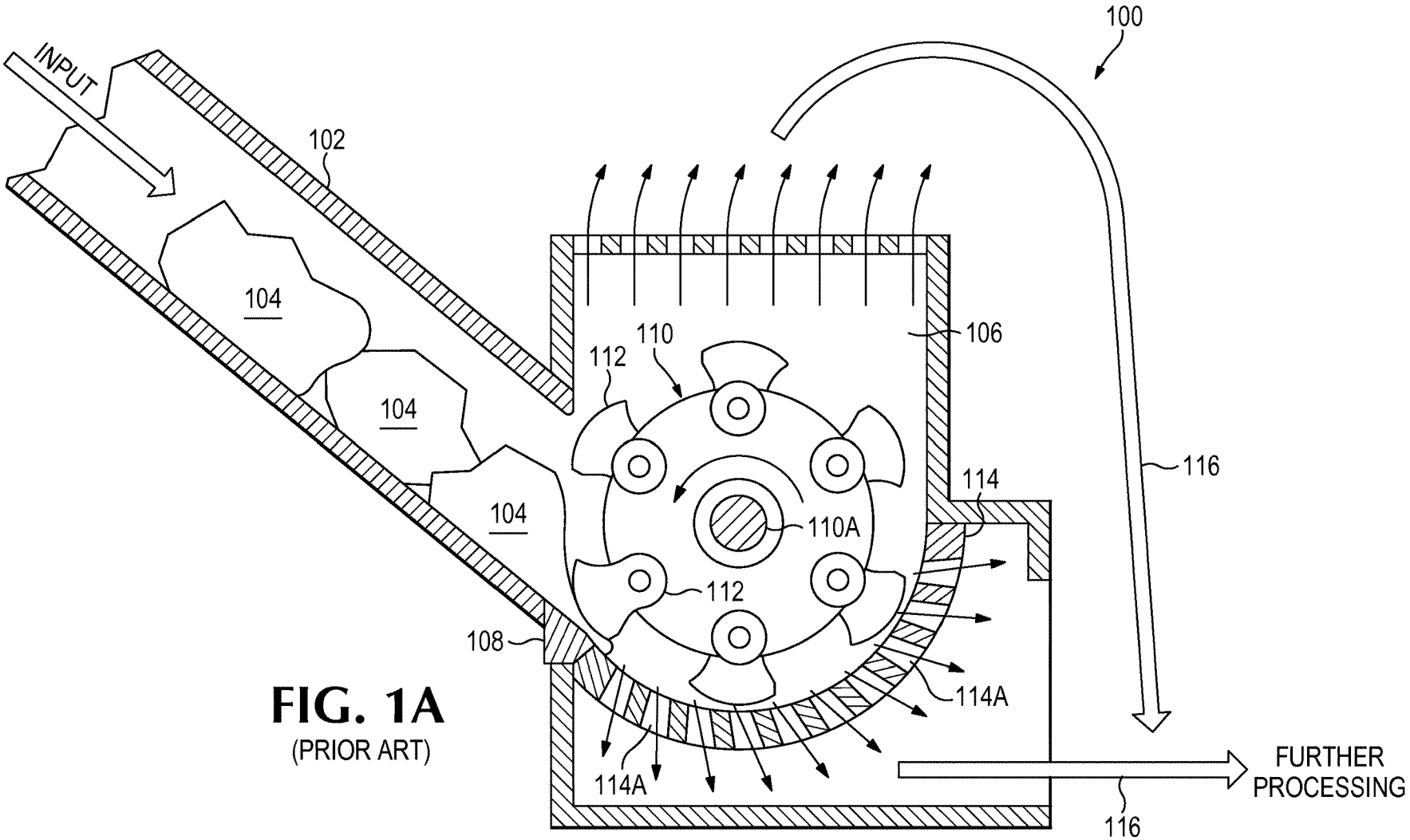
FIG. 1A (PRIOR ART)
FIG. 1A shows a sectional view of a prior art shredding system.
Figure 1B:
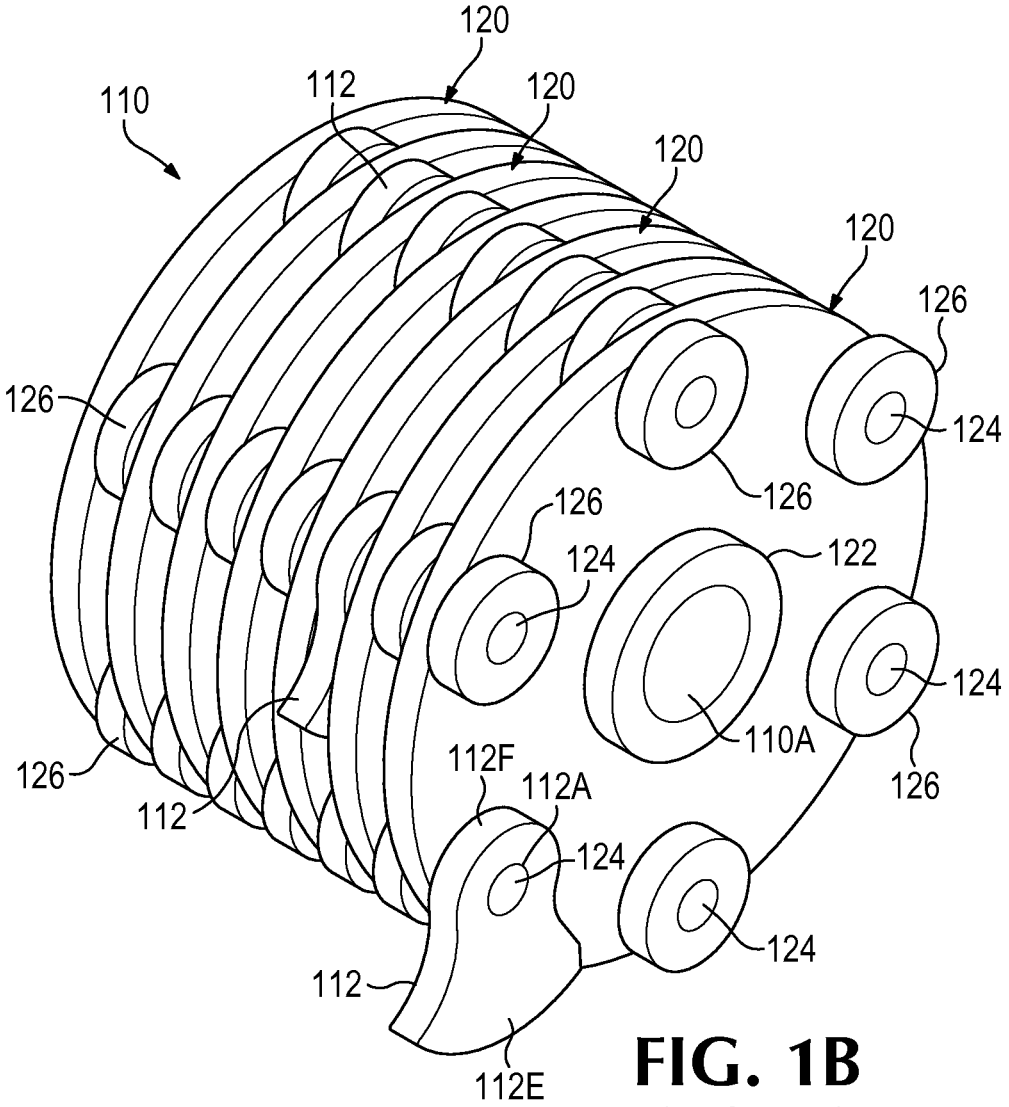
FIG. 1B (PRIOR ART)
FIG. 1B shows a perspective view of the rotary shredding head shown in FIG. 1A.
Figure 1C:
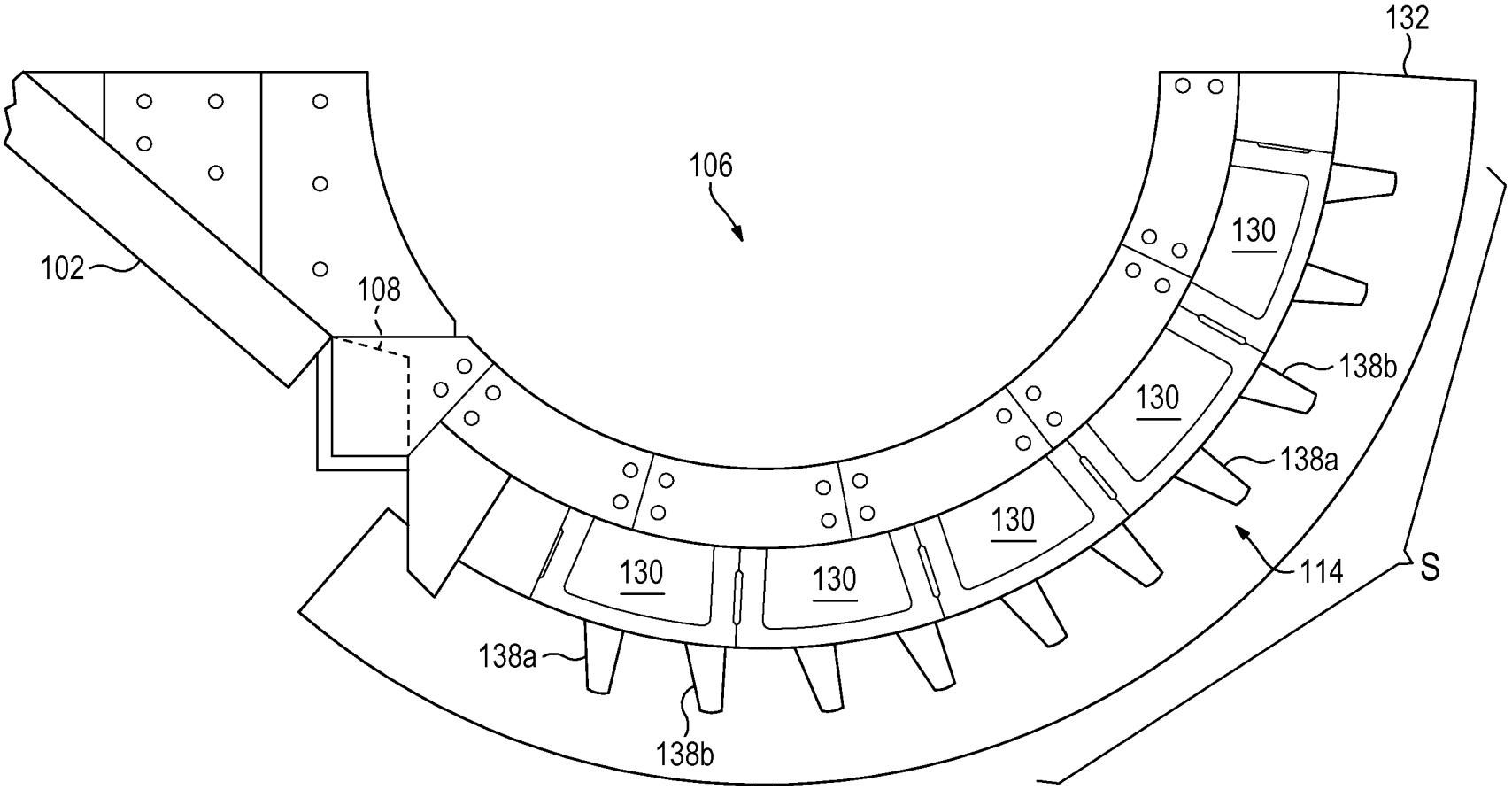
FIG. 1C (PRIOR ART)
FIG. 1C shows a partial cross sectional side view of a prior art shredding system.
Figure 1D:
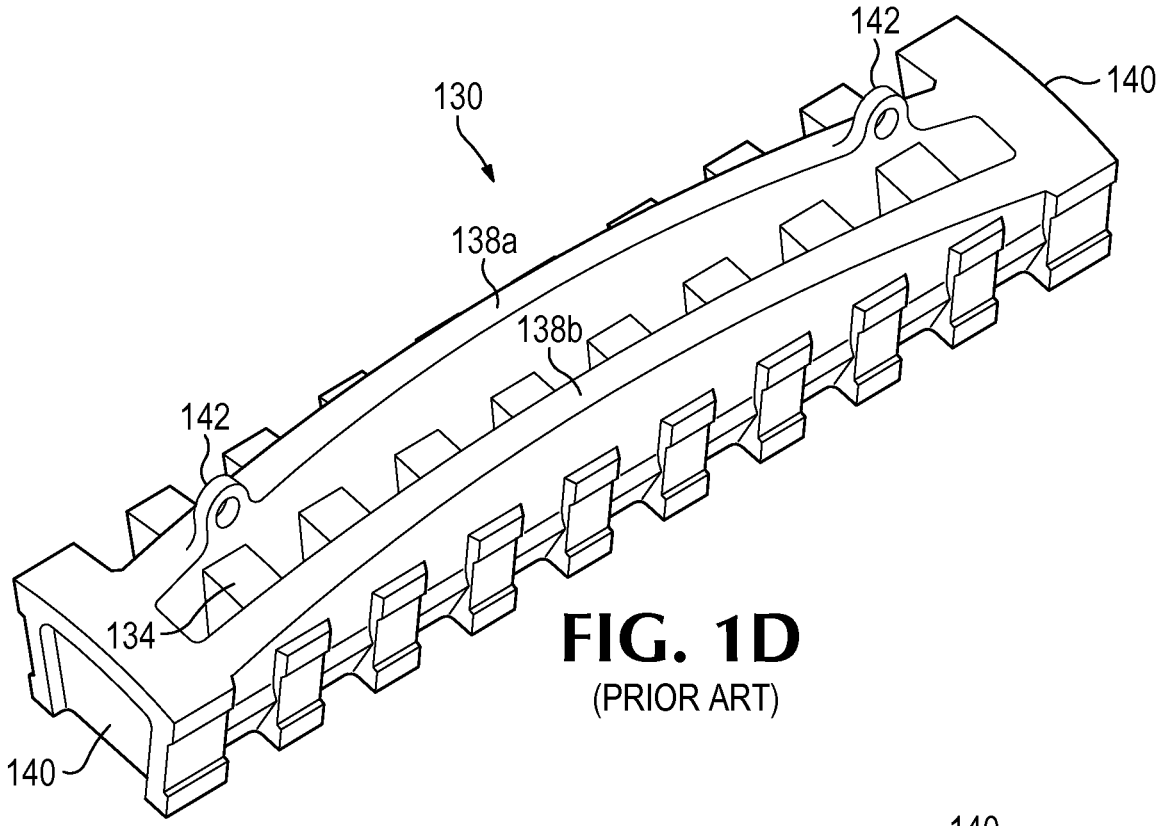
FIG. 1D (PRIOR ART)
FIG. 1D shows a bottom perspective view of one of the grate components shown in FIG. 1C.
Figure 1E:
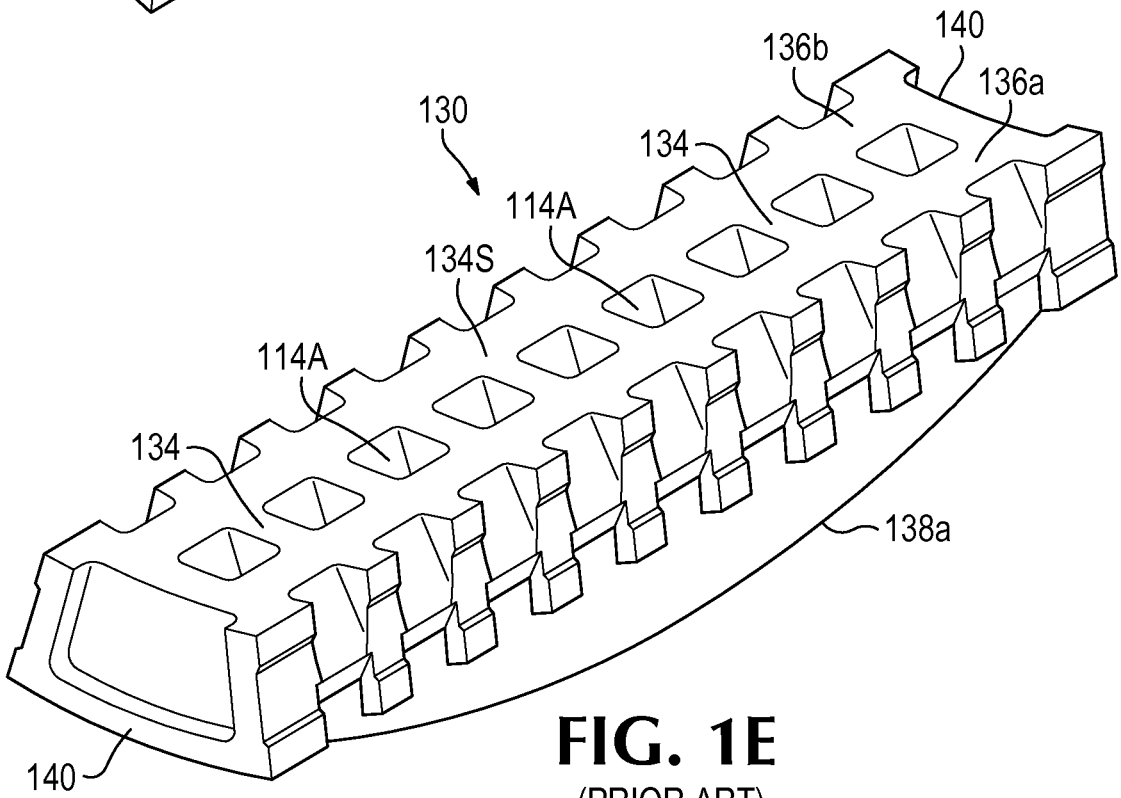
FIG. 1E (PRIOR ART)
FIG. 1E shows a top perspective view of one of the grate components shown in FIG. 1C.
Figure 1F:
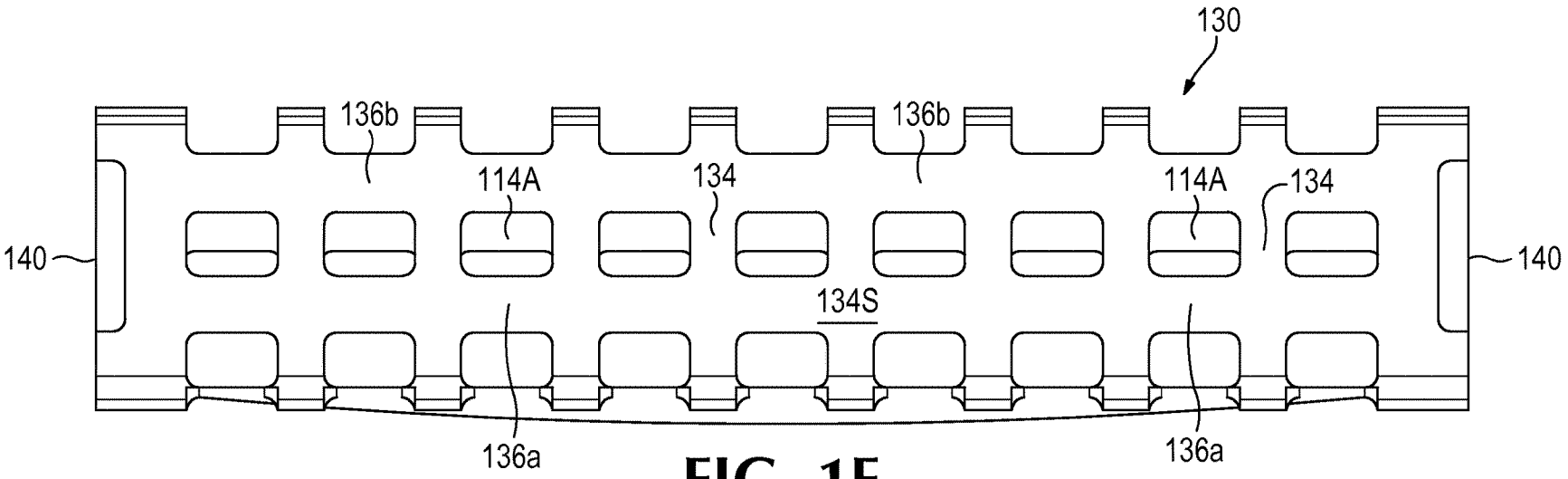
FIG. 1F (PRIOR ART)
FIG. 1F shows a top view of one of the grate components shown in FIG. 1C.
Figure 1G:
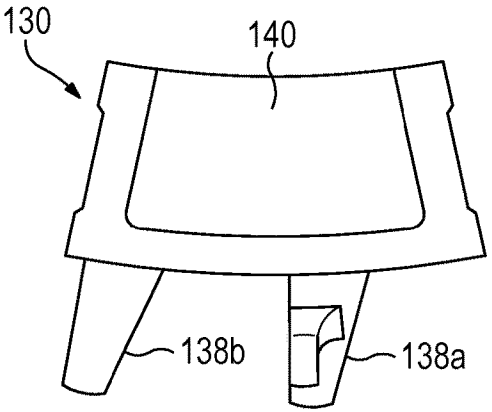
FIG. 1G (PRIOR ART)
FIG. 1G is an end view of one of the grate components shown in FIG. 1C.
Figure 1H:
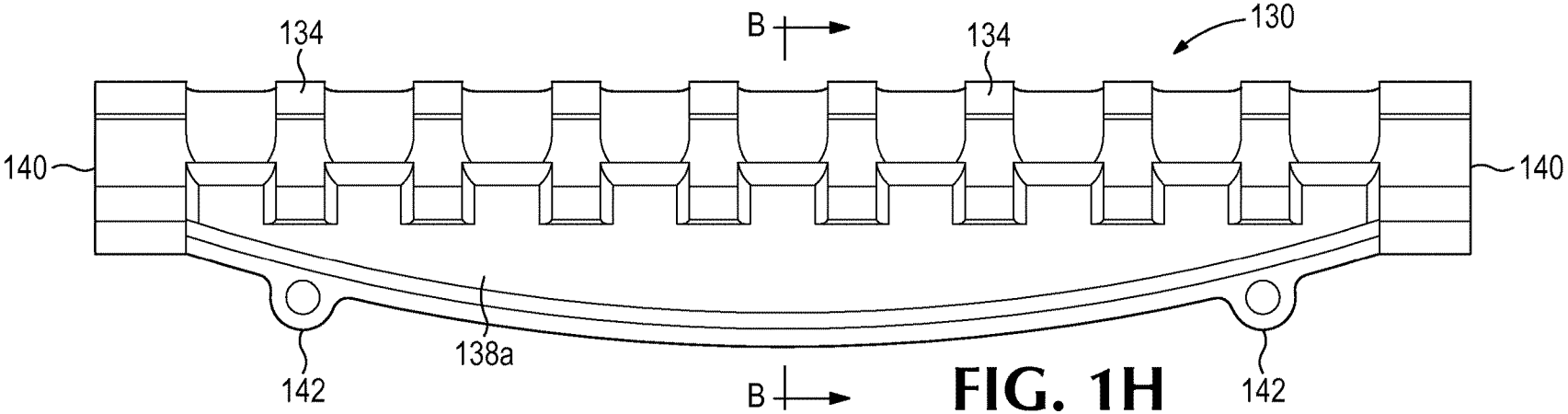
FIG. 1H (PRIOR ART)
FIG. 1H is a front view of one of the grate components shown in FIG. 1C.
Figure 1J:
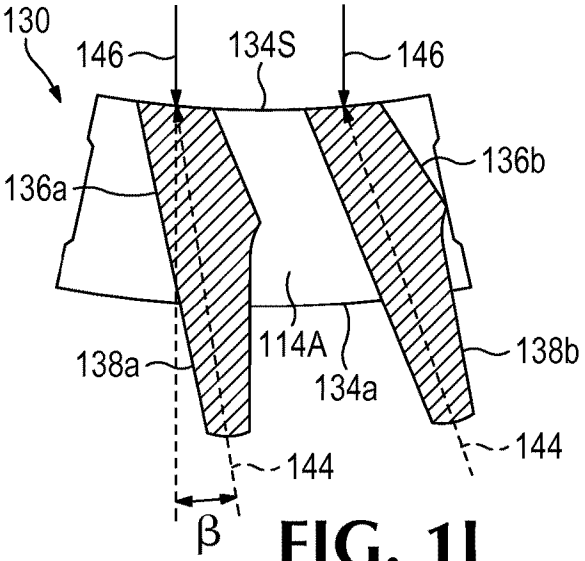
FIG. 1J (PRIOR ART)
FIGS. 1I and 1J are cross sectional views of one of the grate components shown in FIG. 1C taken along line B-B in FIG. 1H.
Figure 1I:
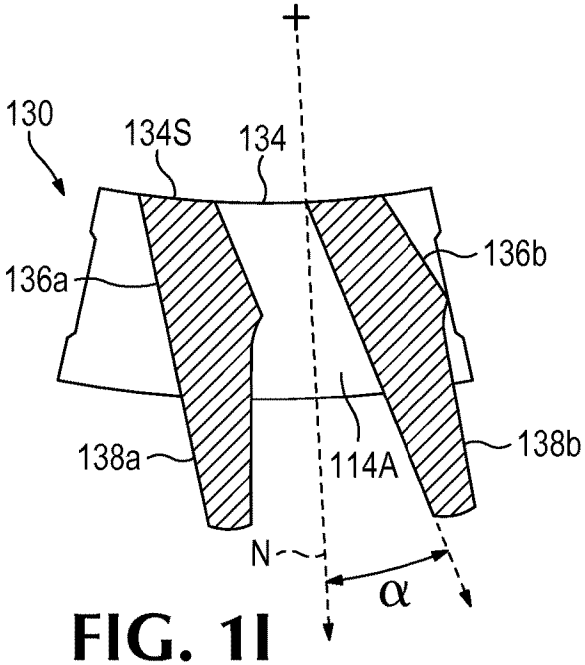
FIG. 1I (PRIOR ART)
Figure 1K:
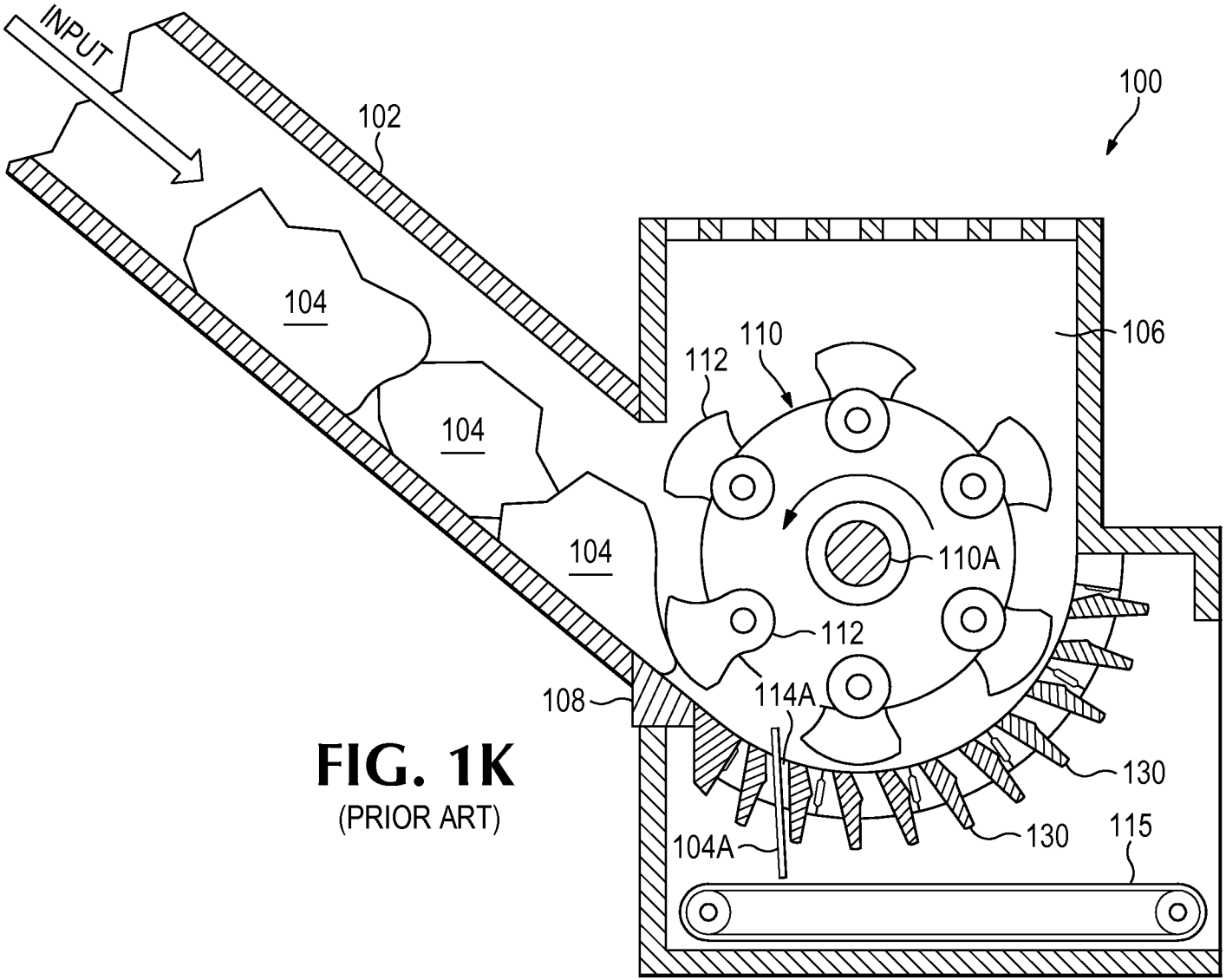
FIG. 1K (PRIOR ART)
FIG. 1K is a sectional view of a prior art shredding system with a poker extending through a discharge grate.
Figure 1L:
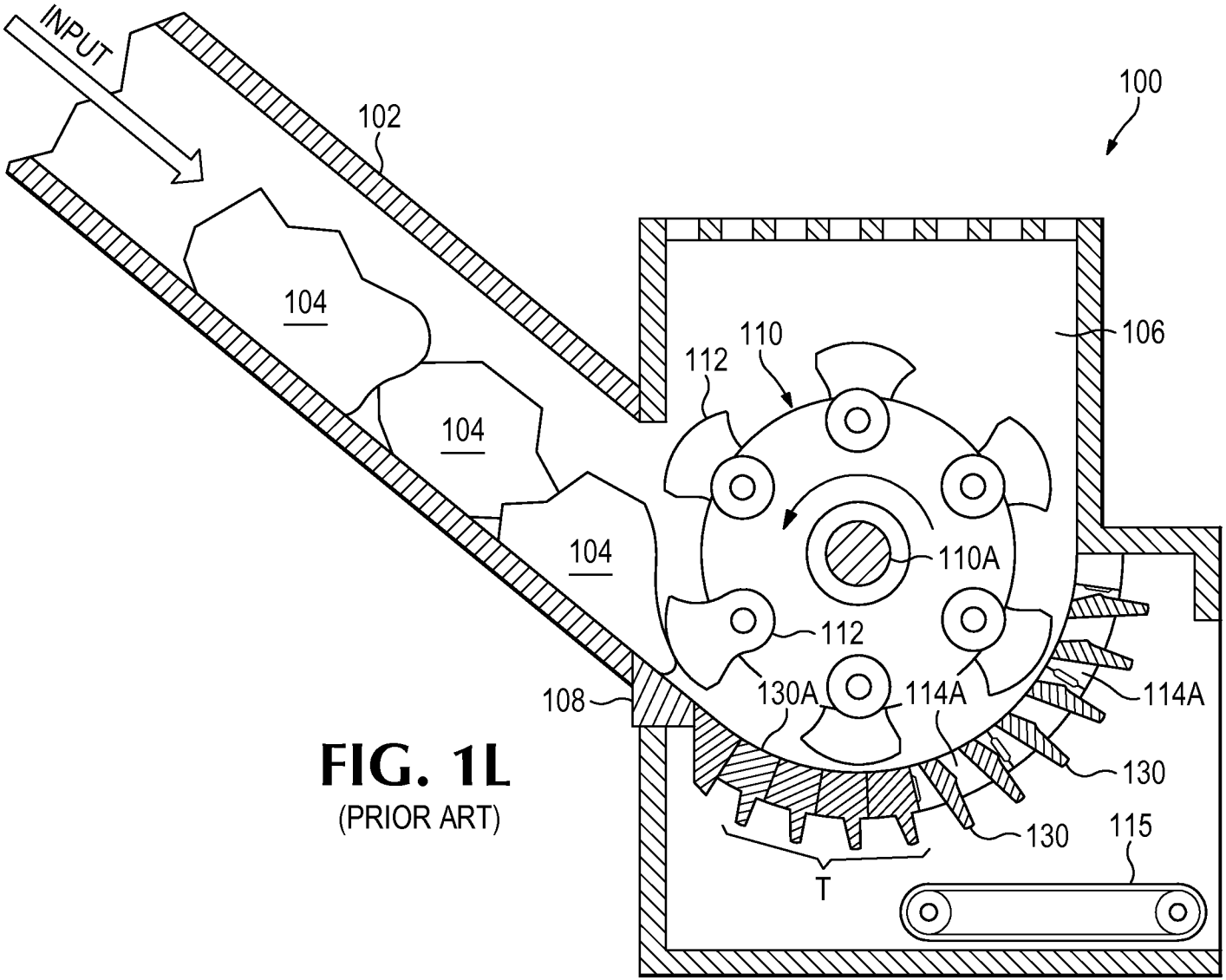
FIG. 1L (PRIOR ART)
FIG. 1L is a sectional view of a prior art shredding system with a grate having both solid grate components and grate components with discharge openings.
Figure 2A:
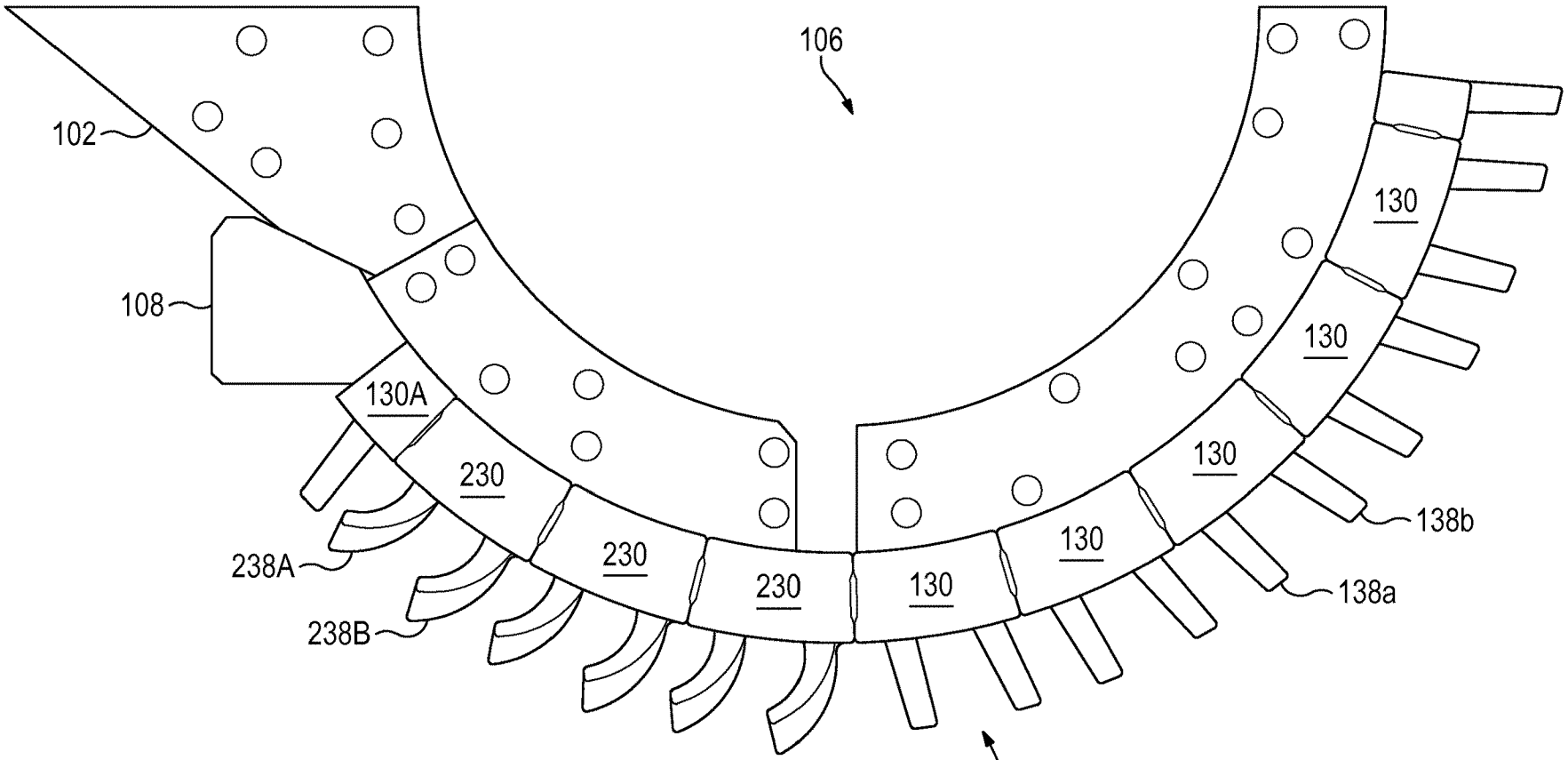
FIG. 2A is a partial cross sectional side view of a prior art shredding system having grate components in accordance with the present invention.
Figure 2B:
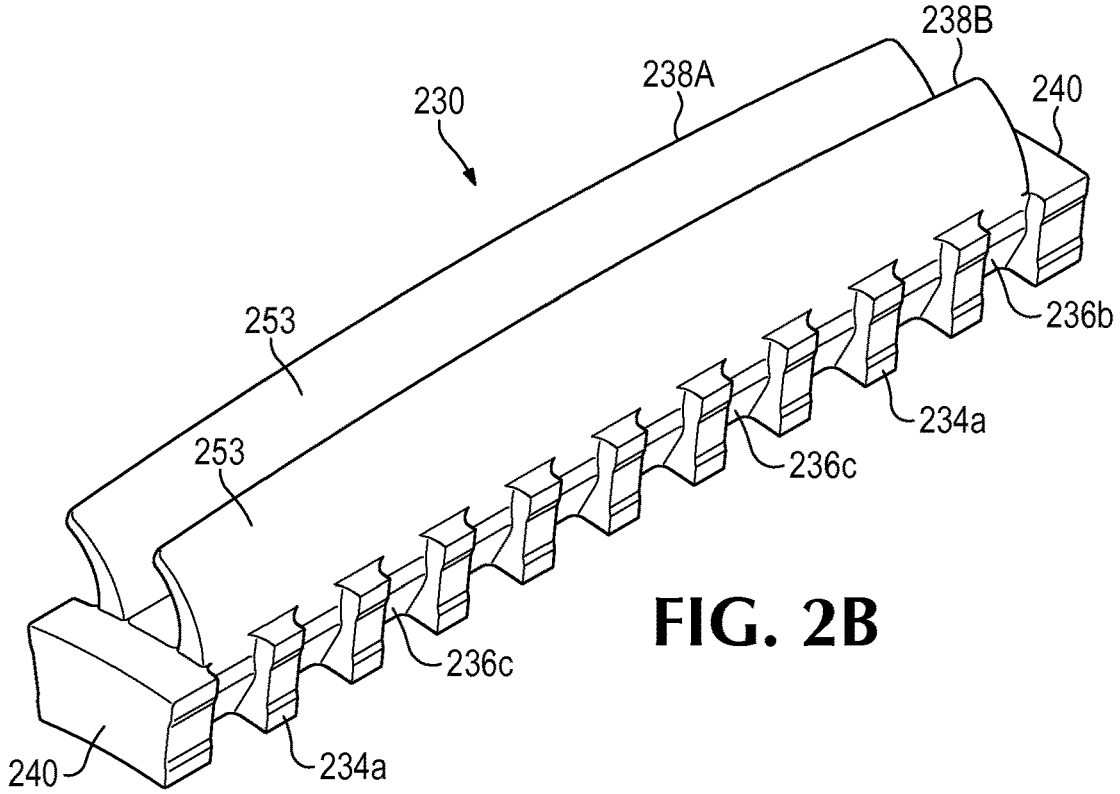
FIG. 2B is a bottom perspective view of a grate component in accordance with the present invention as shown in FIG. 2A.
Figure 2C:
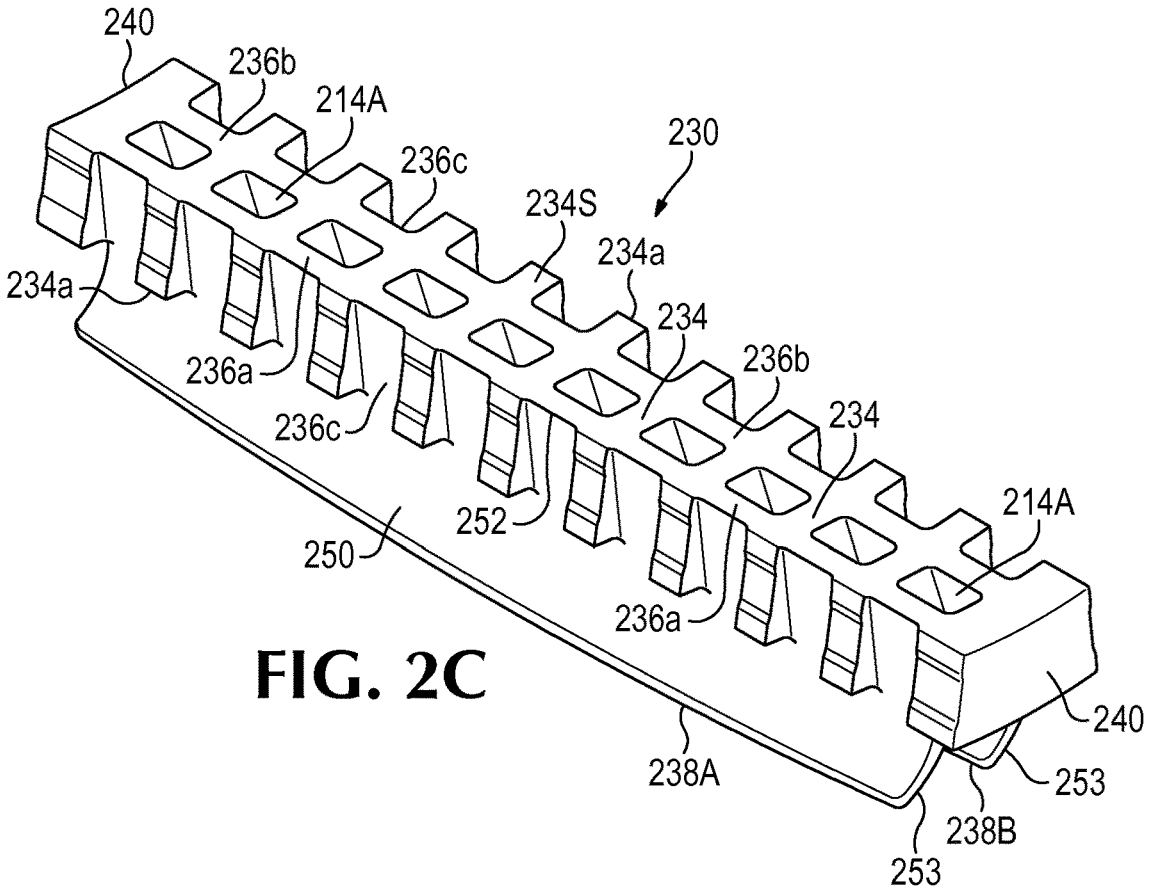
FIG. 2C is a top perspective view of a grate component in accordance with the present invention as shown in FIG. 2A.
Figure 2D:
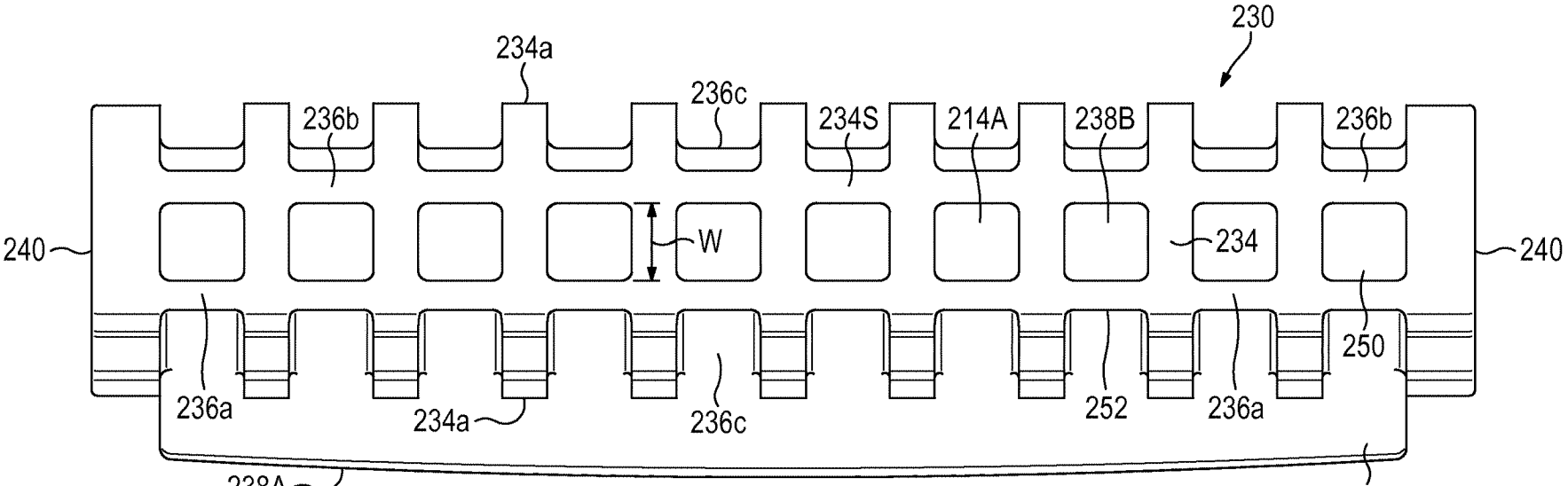
FIG. 2D is a top view of a grate component in accordance with the present invention as shown in FIG. 2A.
Figure 2E:
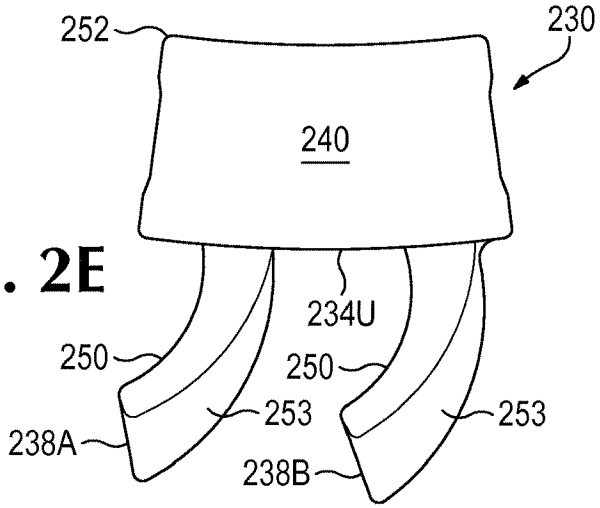
FIG. 2E is an end or side view of a grate component in accordance with the present invention as shown in FIG. 2A.
Figure 2F:
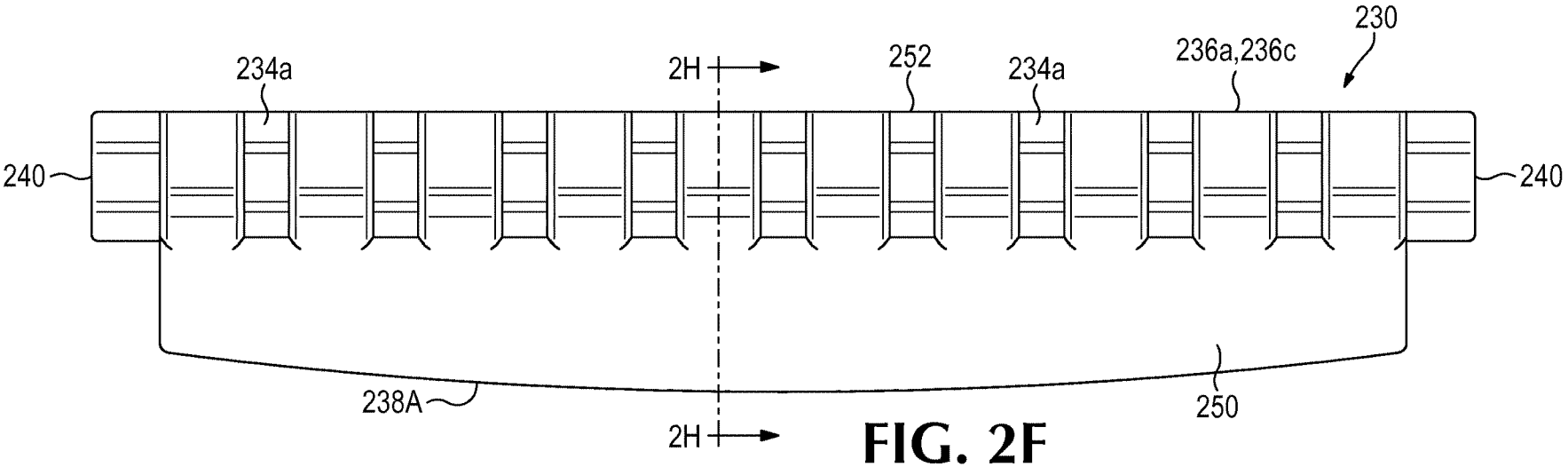
FIG. 2F is a front view of a grate component in accordance with the present invention as shown in FIG. 2A.
Figure 2H:
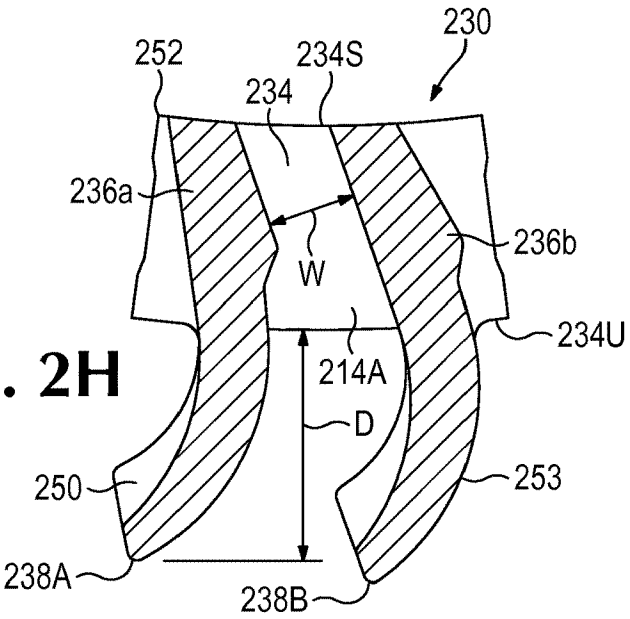
FIG. 2H is a sectional view of the a grate component in accordance with the present invention as shown in FIG. 2A taken along line 2H-2H in FIG. 2F.
Figure 2G:
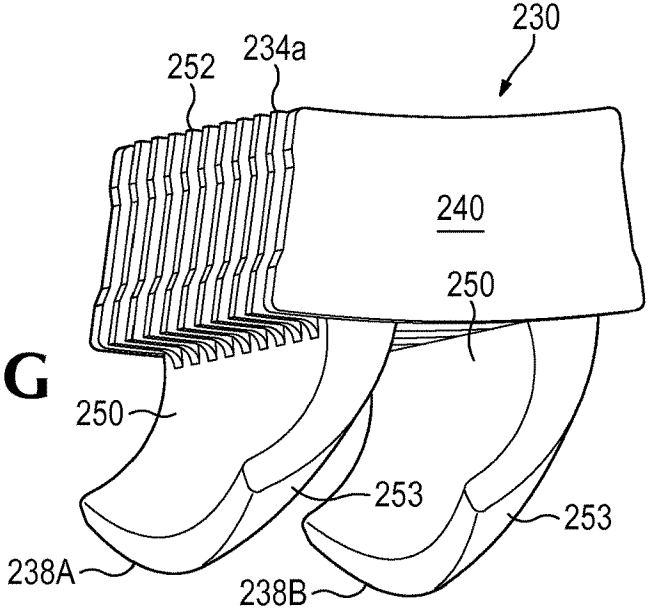
FIG. 2G is a side perspective view of a grate component in accordance with the present invention as shown in FIG. 2A.
Figure 2I:
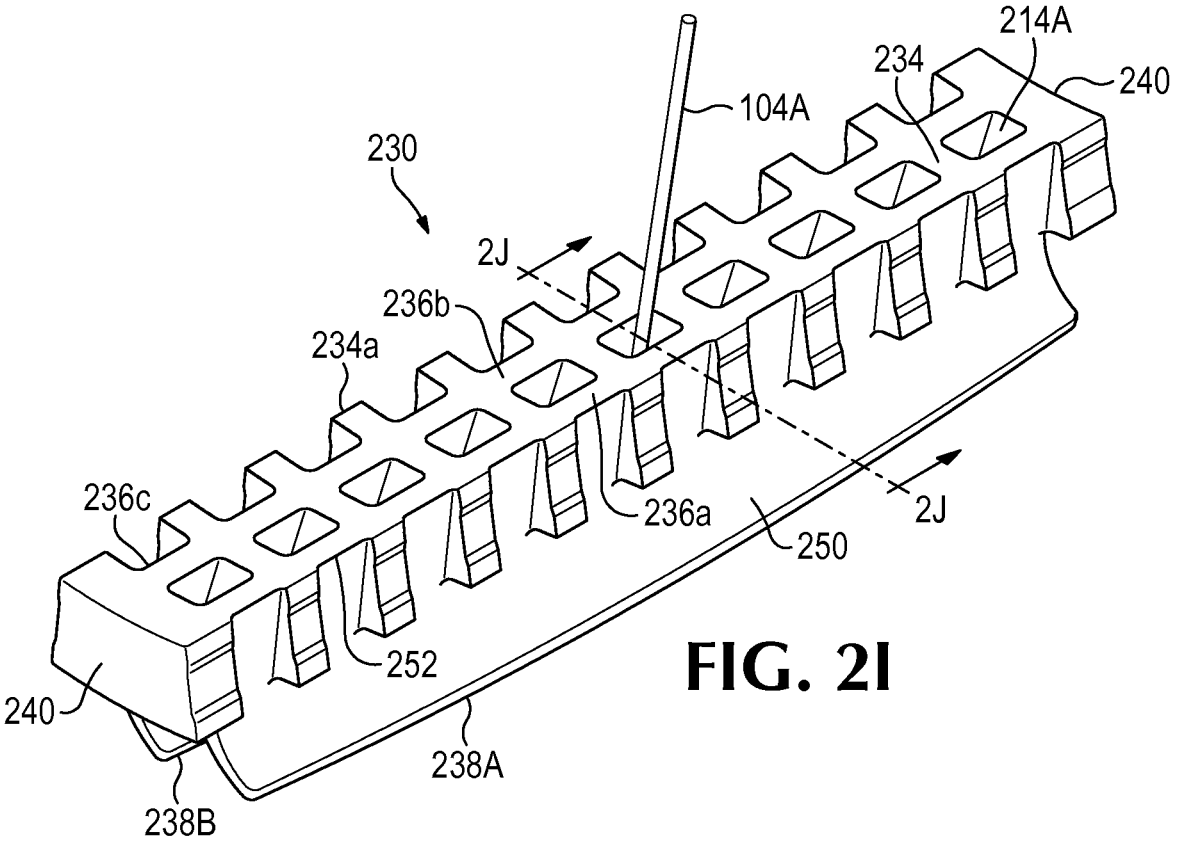
FIG. 2I is a top perspective view of a poker 104A getting caught in a grate component in accordance with the present invention as shown in FIG. 2A.
Figure 2J:
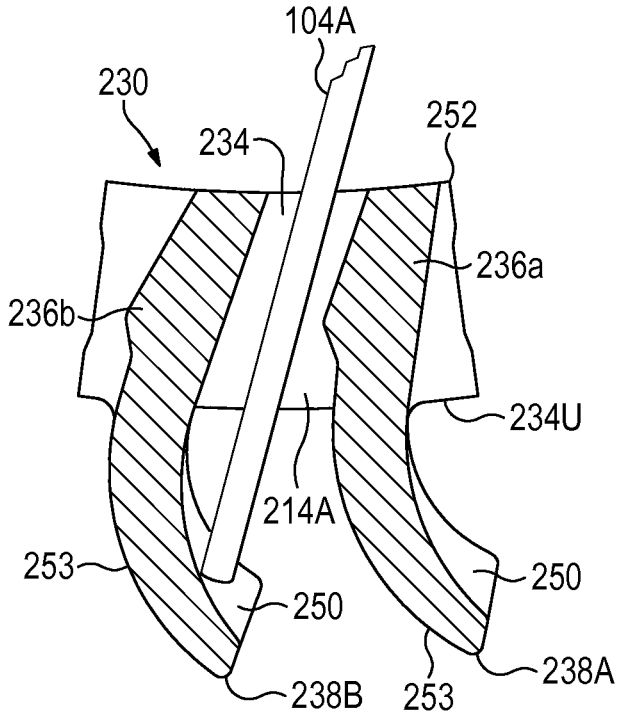
FIG. 2J is a sectional view of a poker 104*a* getting caught in grate component in accordance with the present invention as shown in FIG. 2A taken along line 2J-2J in FIG. 2I.
Figure 3A:
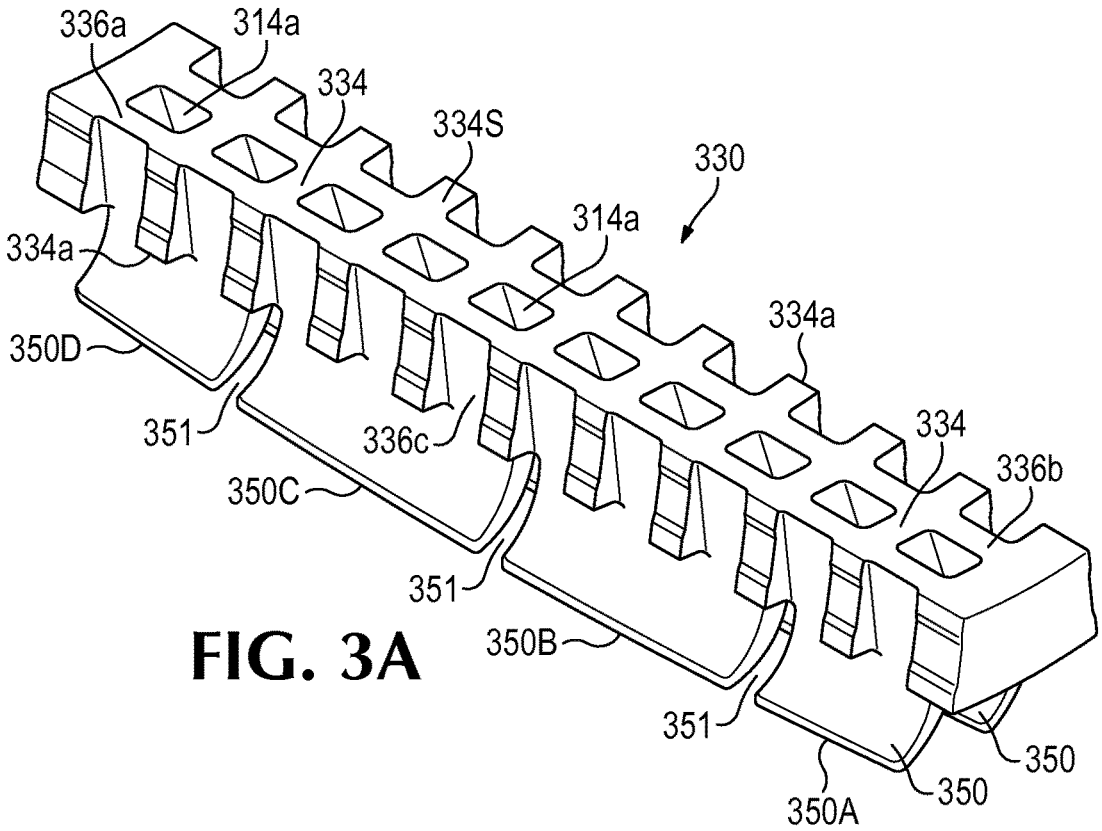
FIG. 3A is a front perspective view of an alternative embodiment of a grate component in accordance with the present invention.
Figure 3B:
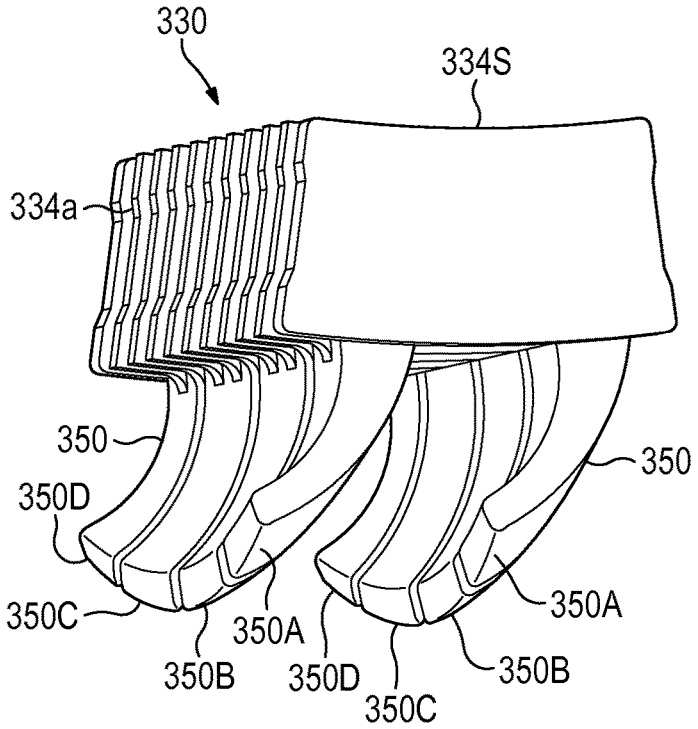
FIG. 3B is a side perspective view of the grate component in accordance with the present invention as shown in FIG. 3A.
Figure 3C:
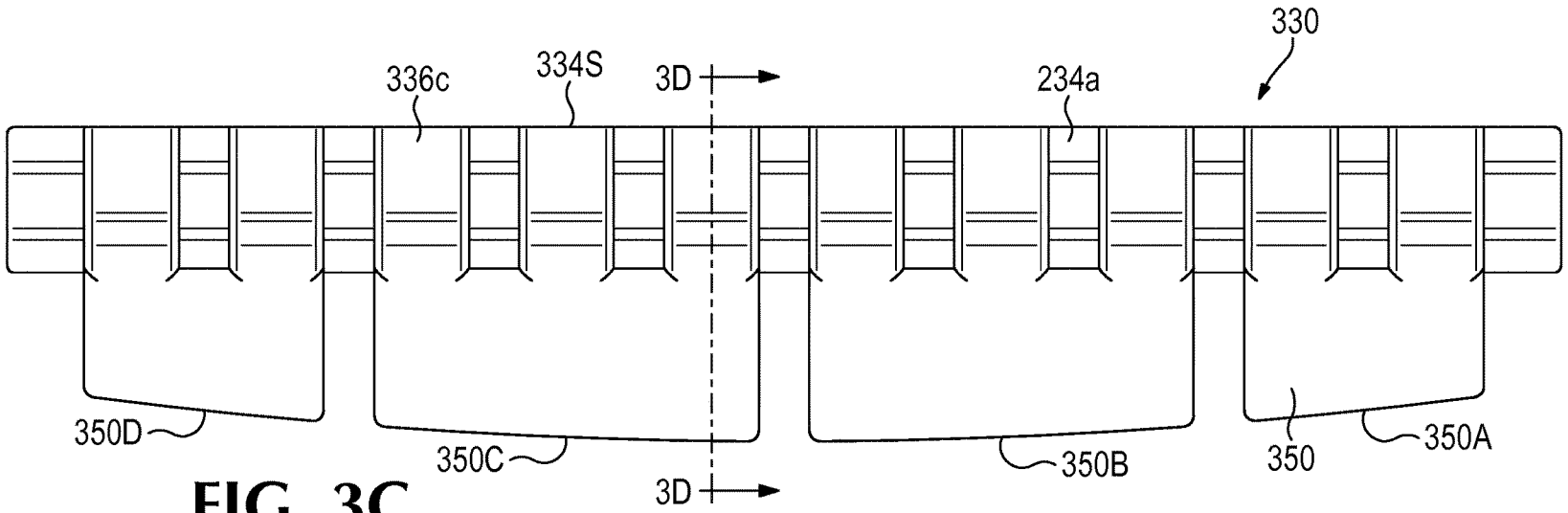
FIG. 3C is a front view of a grate component in accordance with the present invention as shown in FIG. 3A.
Figure 3D:
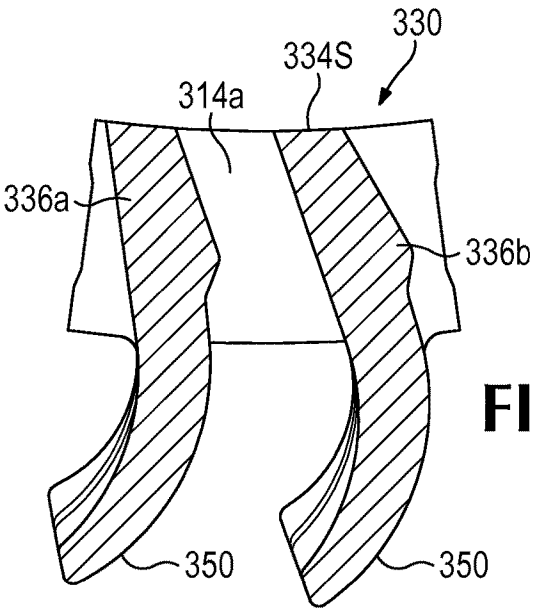
FIG. 3D is a sectional view of the grate component in accordance with the present invention as shown in FIG. 3A taken along line 3D-3D in FIG. 3C.
Figure 3E:
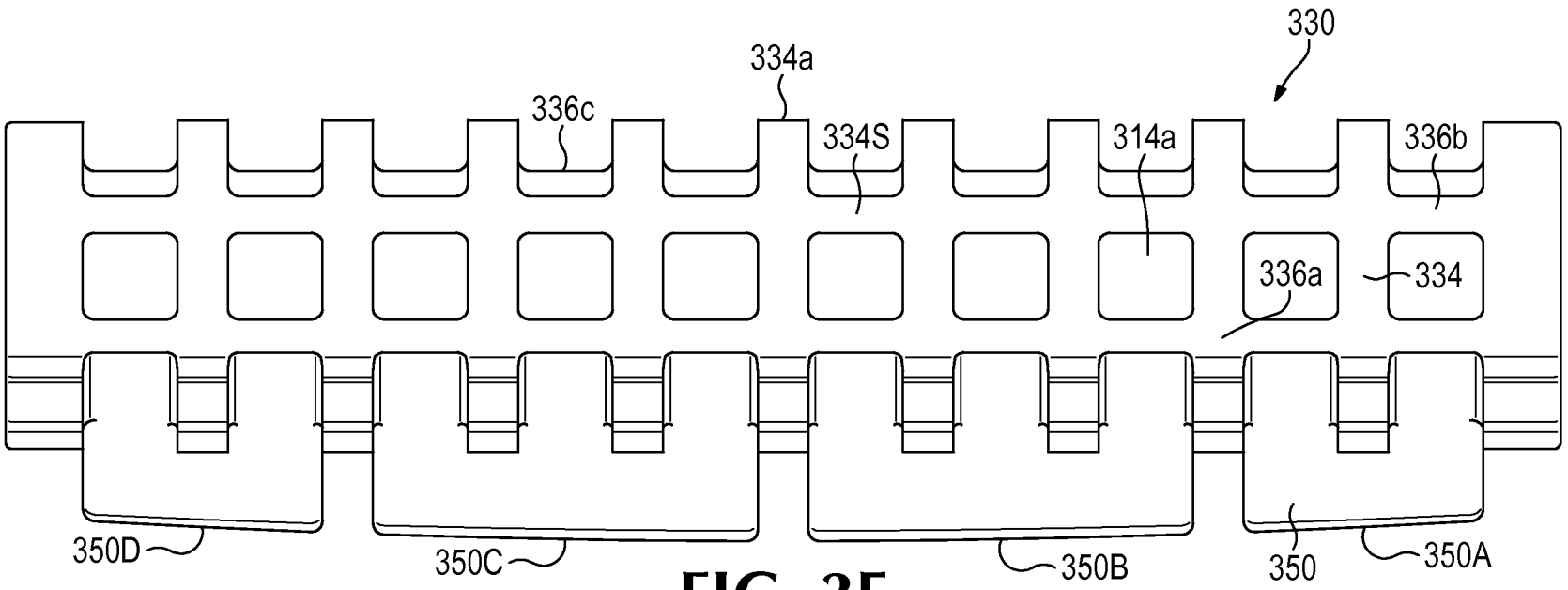
FIG. 3E is a top view of a grate component in accordance with the present invention as shown in FIG. 3A.

FIGS. 2A through 2J illustrate various features of discharge grate basket 214 and individual discharge grate components 230 that form the grates in accordance with examples of this invention. FIG. 2A is a view similar to FIG. 1C showing a discharge grate basket 214 assembled with multiple grate components. In the illustrated embodiment, grate basket 214 is shown with one solid grate component 130A, three grate components 230 that are embodiments of the present invention, and five prior art grate components 130. However, grate basket 214 could have any number of grate components (i.e., there may be more individual grate components or less individual grate components). Similarly grate basket 214 may have any combination of grate components 130A, 130, and 230 (e.g., grate basket 214 could be made entirely of grate components 230 or may only have one or more grate components 230). The individual grate components are aligned and form a portion of a circle around the rotary shredding head (not shown in FIG. 2A). The discharge grate basket 214 also may extend around a greater or lesser portion of the circle around the rotary shredding head. In the illustrated embodiment the frame member with which the grate components engage has not been shown, however, the frame member may have a similar structure to the frame member 132 shown in FIG. 1C. The discharge grate components 230 may include a structure that engages with a corresponding structure provided on a mounting frame, e.g., associated with the shredder or other reduction equipment, to enable the discharge grate components 230 to be mounted on the frame. If desired, the individual discharge grate components 230 according to the invention may include structures that enable them to be engaged with existing reduction equipment (e.g., existing frames 132 provided on conventional shredding or other reduction mill equipment) so that the discharge grate components 230 of the invention might be used to replace conventional discharge grate components (e.g., 130). The discharge grate components 230 are individually engaged with the mounting frame 132 and slid or otherwise moved along the frame 132 to the desired location in the overall discharge grate basket 214 (e.g., using a crane or other lifting equipment).

FIGS. 2B through 2J show various views of an individual discharge grate component 230. As shown in these figures, this discharge grate component 230 includes two longitudinally oriented grate elements 236*a* and 236*b* with a plurality of transverse grate elements 234 extending between the longitudinal grate elements 236*a* and 236*b*. Grate discharge openings 214A are defined between the longitudinal grate elements 236*a* and 236*b* and the transverse grate elements 234 to provide the sieve or webbing structure to the interior working surface 234S of the grate component 230 (see FIGS. 2C and 2D). While generally rectangular shaped discharge openings 214A are shown at the working surface 234S in this illustrated example grate basket 214, other opening sizes and shapes also may be used without departing from this invention, including different discharge opening sizes and shapes within an individual grate component 230 and/or within a single grate basket 214. Each grate component can also include more or fewer longitudinal or transverse grate elements than in the illustrated example.

The transverse grate elements 234 preferably include extensions or exterior transverse grate elements 234*a* that extend beyond longitudinal grate element 236*b* and the fully defined openings 214A, i.e., in both directions from the outer sides 236*c* of longitudinal grate elements 236*a* and 236*b*. These extension portions 234*a* cooperate with similar extension portions 234*a* of an adjacent discharge grate components 230 to form grate discharge openings 214A in areas between adjacent discharge grate components 230 when the plurality of grate discharge components 230 are mounted in a discharge grate basket 214. Although it is not a requirement, the exterior transverse grate elements 234*a* of this example structure are continuous with (and align with) the transverse grate elements 234 provided between the longitudinal grate elements 236*a*, 236*b*. In alternative embodiments, the grate component 230 may only have one longitudinal grate element and may only have exterior transverse grate elements (not shown). Also, in the illustrated embodiment, the extensions 234*a* extend farther in one direction than the other, but they could be the same, reversed or have other configurations than shown.

In this example, a support 238A or 238B extends outward of each of the longitudinal grate elements 236*a* and 236*b* to prevent the grate component from bending and twisting under the high impact forces experienced as the material to be shredded passes over the grate components. In the illustrated example, the grate component structure 230 has two longitudinal supports 238A and 238B that are integral with and extend outward of each longitudinal grate elements 236*a* and 236*b*. In alternative embodiments, the grate may have just one support beam (e.g., for example the grate may have one longitudinal support element in accordance with U.S. patent application Ser. No. 14/248,107 filed Apr. 8, 2014 entitled "Discharge Grates For Reduction Mills" which is incorporated herein by reference in its entirety). In alternative embodiments, the longitudinal support beams may extend from the transverse grate elements 234 or 234*a* (not shown). In addition, the longitudinal support beams 238A and 238B may be supported at their ends by one or more of the ends 240 of the grate component 230, and/or be supported by portions of the transverse grate elements and the longitudinal grate elements.

In the illustrated embodiment, the longitudinal support beams 238A and 238B each form an integral stop 250 on the surface facing the anvil 108, i.e., the front or upstream surface. Stops 250 extend along the entire length of longitudinal support beams 238A and 238B. Stops 250 minimize the velocity with which pokers 104A travel through grate component 230, and inhibit pokers from impacting conveyors and other downstream equipment at high rates of speed. Stops 250 are designed so that discharged material has a minimal straight line path through the grate basket 214. The longitudinal support beam 238B extends outward of longitudinal component 236*b* and towards longitudinal component 236*a*. Likewise, longitudinal support beam 238A extends outward of longitudinal component 236*a* and extends forward or upstream of the leading edge 252 of the interior working surface 234S so that the stop 250 on longitudinal support beam 238A prevents pokers from exiting discharge grate opening 214A at a high rate of speed in front of longitudinal component 236*a* to the equipment below grate basket 214. In one preferred embodiment, the stops 250 are designed so that discharged material has no straight line path through the grate basket 214. The stops 250 face in directions that may include, to a minor extent, a direction opposite the direction of the material flow over the grate, i.e., when the grate 230 is installed in the shredding system 100, the stop that faces an opposite direction faces in an upstream direction towards the material inlet 102.

In a preferred embodiment, the supports 238A and 238B have a gradual curve in an upstream direction to define the stop 250 with minimal obstructions to the passage of other reduced or shredded material through openings 214A and onto the conveyor or other collecting equipment. In one preferred embodiment, the supports 238A and 238B are continuously curved as they extend away from the exit of the discharge opening 214A. In one preferred embodiment, at least the supports 238A and 238B are also longitudinally curved and concave in an upstream direction. In alternative embodiments not shown, the supports may have shapes other than continuously curved, may not be concave downstream, may not extend forward of the leading edge of the interior working surface, or may not extend along the entire length of the longitudinal support beam. In addition, there may be only one stop on the grate component, there may be more than two stops on the grate component, or there may be multiple stops extending along each longitudinal support beam. One support may be curved over a pair of the discharge openings to define a stop for both. Further, the stop may be separate and spaced apart from the longitudinal support beams and may, for example, not provide any structural support for the grate component. However in one preferred embodiment, the stops 250 are an integral part of the longitudinal support beams and are an integral part of the longitudinal grate elements so that the stops 250 provide structural support for the grate component 230. The supports 238A and 238B may also have various non-curved shapes.

The grate component 230 has an outer surface 234U that is opposite the interior working surface 234S (i.e., the outer surface adjacent the exit of discharge openings 214A). The depth that the stops 250 extend outward and away from outer surface 234U is preferably determined by the sizing of the discharge grate openings 214A. The discharge openings

214A have a width W in the direction of the material flow over the grate. Width W is measured between the two elements that define the discharge grate opening and is measured where the distance between the two elements is the smallest (e.g., in FIGS. 2D and 2H the width W is measured from the rear surface of longitudinal grate element 236*a* to the leading surface of longitudinal grate element 236*b*). The stop 250 has a depth D such that it extends below the underside surface 234U. Depth D is measured from the outer surface 234U to the outer extremity of the support such as 238A or 238B that provides and constitutes the stop. Thus, the stop 250 starts at the surface 234U, and is not a formation solely at the outer end of the depth D on the support 238A, B. In one preferred embodiment, the width W of the discharge openings 214A to the depth D of the stop 250 has a ratio of less than 0.95 (i.e., W/D<0.95). In another preferred construction, the width W to depth D ratio is less than or equal to 0.6. Other ratios higher and lower, though, are also possible.

Each longitudinal support beam 238A and 238B has a rear surface 253 that generally faces downstream, i.e., in the same direction as the direction of the material flow over the grate 230. In one preferred construction, the surface 253 is arcuate as the surfaces extends outward and away from the discharge openings 214A such that the surface 253 curves in a direction opposite the direction of material flow over the grate, although other shapes are possible. In one preferred construction, at least the bottom of the longitudinal support beam is longitudinally convex. Having the longitudinal support beams 238A and 238B curved into a direction opposite the direction of the material flow minimizes the amount of material that will be caught on the support beam when the grate component is installed in grate basket 214 such that the grate component is oriented between approximately 30 degrees and 180 degrees relative to the material inlet in a direction of the movement of the rotational axis 110A of the head 110 (i.e., when installed in a position between approximately the 3 and 8 o'clock positions in the shredding system). In other embodiments, the grate component is oriented between approximately 60 degrees and 120 degrees relative to the material inlet in a direction of the rotational axis of the head (i.e., in a position between approximately the 5 and 7 o'clock positions in the shredding system). Thus the longitudinal support beam 238A and 238B are less likely to act as shelves on which discharged shredded material hangs up.

In an alternative embodiment (FIGS. 3A-3E), grate component 330 is similar in many ways to grate component 230 with many of the same benefits and purposes. The following discussion focuses on the differences and does not repeat all the similarities that apply to grate component 330. Grate component 330 is designed to be used in a shredding system that has transverse support beams (not shown) in the mounting frame. In the illustrated embodiment, the grate component 330 is designed to be used in a shredding system that has three transverse support beams in the mounting frame. The transverse support beams in the mounting frame prevent the grate component 330 from bending and twisting under the high impact forces experienced as the material to be shredded passes over the grate components. Thus, there is no need for grate component 330 to have longitudinal support beams 238A or 238B.

Grate component 330 has two longitudinally oriented grate elements 336*a* and 336*b* with a plurality of transverse grate elements 334 extending between the longitudinal grate elements 336*a* and 336*b*. The grate discharge openings 314*a* are defined between the longitudinal grate elements 336*a* and 336*b* and the transverse grate elements 334 to provide the sieve or webbing structure to the interior working surface 334S of the grate component 330 (see FIG. 3E). The transverse grate elements 334 preferably include extensions or exterior transverse grate elements 334*a* that extend beyond longitudinal grate element 336*b* and the fully defined openings 314A, i.e., in both directions from the outer sides 336*c* of longitudinal grate elements 336*a* and 336*b*. These extension portions 334*a* cooperate with similar extension portions 334*a* of an adjacent discharge grate components 330 to form grate discharge openings 314A in areas between adjacent discharge grate components 330 when the plurality of grate discharge components 330 are mounted in a discharge grate basket. Grate component 330, like grate component 230, has multiple longitudinal stops 350. The stops 350 are integral with and extend outward of each longitudinal grate elements 336*a* and 336*b*. Stops 350 minimize the velocity with which pokers travel through grate component 330, and inhibit pokers from impacting conveyors and other downstream equipment at high rates of speed. Unlike stops 250, stops 350 provide limited longitudinal support. Instead each longitudinal stop 350 is provided with gaps 351 to allow the transverse support beams (not shown) in the mounting frame to pass through the stops 350. In the illustrated embodiment, the gap 351 in each longitudinal stop 350 creates four stop sections 350A, 350B, 350C, and 350D.

Figure 4A:
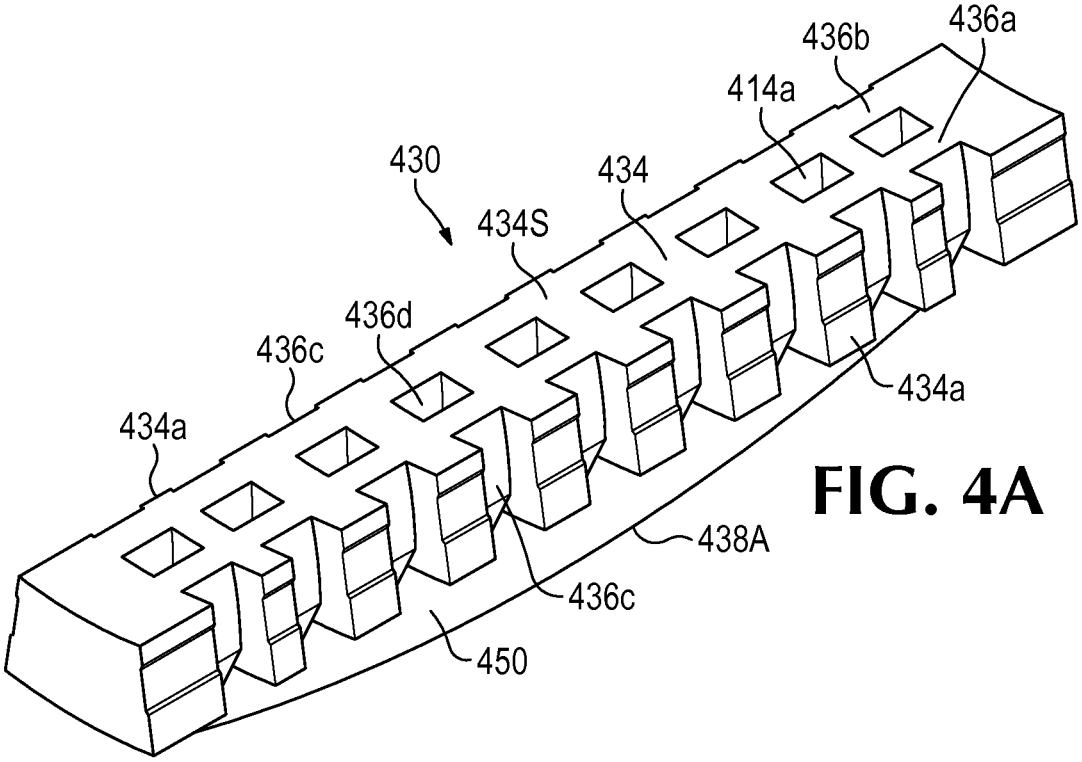
FIG. 4A is a front perspective view of an alternative embodiment of a grate component in accordance with the present invention.
Figure 4B:
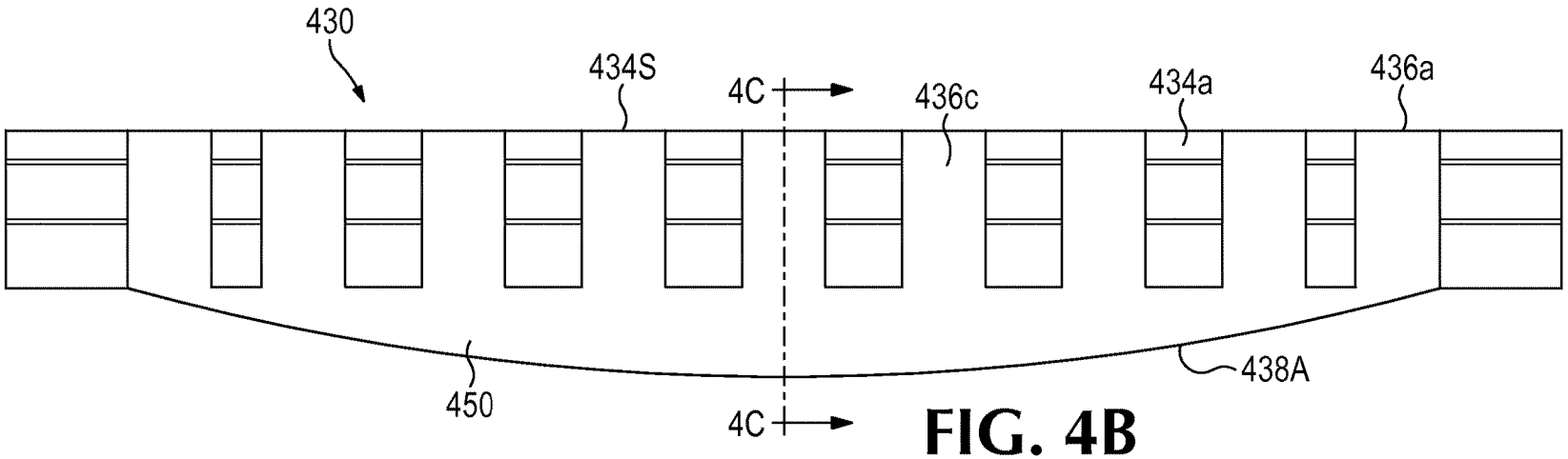
FIG. 4B is a front view of a grate component in accordance with the present invention as shown in FIG. 4A.
Figure 4D:
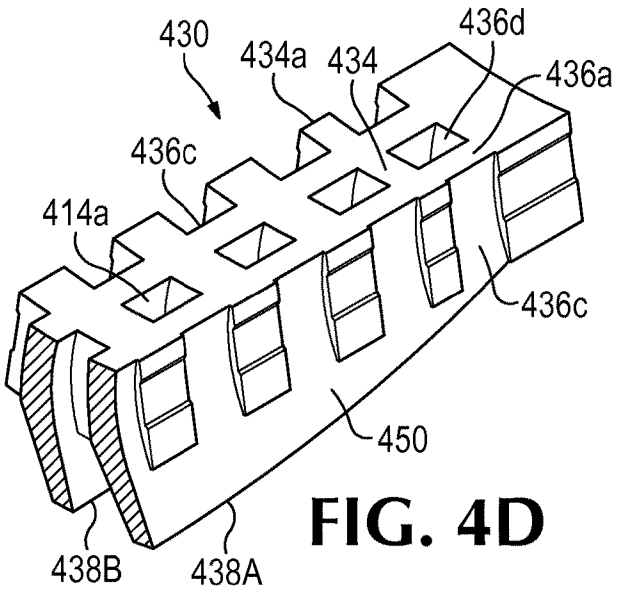
FIG. 4D is another front perspective view of a grate component in accordance with the present invention as shown in FIG. 4A.
Figure 4C:
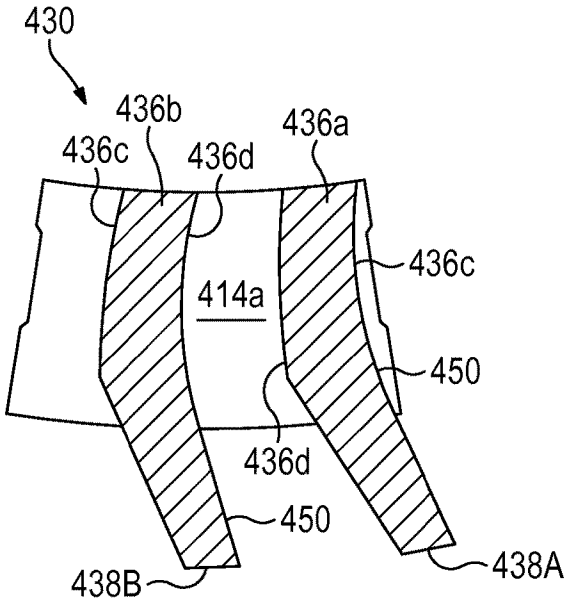
FIG. 4C is a sectional view of the grate component in accordance with the present invention as shown in FIG. 4A taken along line 4C-4C in FIG. 4B.

In an alternative embodiment (FIGS. 4A-4D), grate component 430 is similar in many ways to grate component 230 with many of the same benefits and purposes. Grate component 430 has two longitudinally oriented grate elements 436*a* and 436*b* with a plurality of transverse grate elements 434 extending between the longitudinal grate elements 436*a* and 436*b*. The grate discharge openings 414*a* are defined between the longitudinal grate elements 436*a* and 436*b* and the transverse grate elements 434 to provide the sieve or webbing structure to the interior working surface 434S of the grate component 430 (see FIG. 4A). The transverse grate elements 434 preferably include extensions or exterior transverse grate elements 434*a* that extend beyond longitudinal grate element 436*b* and the fully defined openings 414A, i.e., in both directions from the outer sides 436*c* of longitudinal grate elements 436*a* and 436*b*. These extension portions 434*a* cooperate with similar extension portions 434*a* of an adjacent discharge grate components 430 to form grate discharge openings 414A in areas between adjacent discharge grate components 430 when the plurality of grate discharge components 430 are mounted in a discharge grate basket. Grate component 430, like grate component 230, has longitudinal supports 438A and 438B that extend outward of each of the longitudinal grate elements 436*a* and 436*b* to prevent the grate component from bending and twisting under the high impact forces experienced as the material to be shredded passes over the grate components.

In the illustrated embodiment, grate component 430 has stops 450, similar to stops 250 in grate component 230. However, in this embodiment the inner and outer sides 436*d* and 436*c* of longitudinal grate elements 436*a* and 436*b* are curved in such a way that the stops 450 begin within discharge openings 414A and extend outward of each longitudinal grate elements 336*a* and 336*b*. In alternative embodiments, the inner and outer sides 436*d* and 436*c* of longitudinal elements 436*a* and 436*b* may have a shape other than curved and yet still define a stop. Because stops 450 begin within discharge opening 414A, the discharge openings 414A minimizes the velocity with which pokers travel through grate component 430, and inhibit pokers from impacting conveyors and other downstream equipment at high rates of speed. In an alternative embodiment not shown, the longitudinal grate elements may have an inner and outer side that is curved or otherwise oriented in such a way to define a stop within the discharge opening without the need for the stop to extend outward of each longitudinal grate element so that the stop is completely within the discharge openings.

Although preferred embodiments are described above, other arrangements are possible for grates and grate components in accordance with the invention. Different aspects of the invention can be used in isolation to achieve some of the benefits of the invention. A variety of different configurations could be used to form the grate openings 214A, the end supports 240, the longitudinal support beam 238A and 238B, the grate elements 236*a*, 236*b*, 234, and other disclosed features. Any combination of described features that performs at least some portion of the disclosed functions and/or provides at least some portion of the disclosed advantages falls within the scope of this specification. While a grate component with dual longitudinal grate components and dual stops (a so-called "double grate component") is preferred, aspects of the invention are usable with grate components provided with a single beam and a single stop (a so-called "single grate component"), or double grate components with two support beams, two stops, and two longitudinal grate elements. In addition, aspects of the invention are usable with grate components provided with more than two longitudinal grate elements, grate components with more than two support beams, or grate components with more than two stops.

The invention claimed is:

1. A discharge grate component for use in a reduction machine, the discharge grate component comprising:

intersecting members engaging each other to define a common interior working surface with discharge openings, and at least one stop extending outward the common interior working surface and from one of the intersecting members such that a substantial portion of the at least one said stop extends upstream to limit straight line paths of material through at least some of the discharge openings.

2. A discharge grate component in accordance with claim 1 wherein the at least one said stop extends outward of the discharge openings in at least partially a curved configuration.

3. A discharge grate component in accordance with claim 1 wherein the intersecting members include at least one longitudinal grate element and a plurality of transverse grate elements to form the discharge openings through the grate component, and wherein the at least one stop defines at least one longitudinal support beam to resist bending and deflection of the overall discharge grate component.

4. A discharge grate component in accordance with claim 1 wherein the at least one said stop has an upstream surface with a concave curvature in a direction opposite a direction of material flow over an interior working surface.

5. A discharge grate component in accordance with claim 1 wherein the discharge grate component has at least one longitudinal support beam to resist bending and deflection of the overall discharge grate component.

6. A discharge grate component is accordance with claim 3 wherein the discharge openings define at least a portion of the at least one said stop.

7. A discharge grate component in accordance with claim 1 wherein the at least one said stop is generally continuously curved as it extends away from the discharge openings.

8. A discharge grate component for use in a reduction machine, the discharge grate component comprising:

intersecting members to define an interior surface and discharge openings, and at least one stop extending outward of the discharge openings and at least partially curved in a direction opposite a direction of material flow over the interior surface to limit straight line paths of material through at least some of the discharge openings.

9. A discharge grate component in accordance with claim 8 wherein the intersecting members include at least one longitudinal grate element and a plurality of transverse grate elements to form the discharge openings through the grate component, and wherein the at least one stop defines at least one longitudinal support beam to resist bending and deflection of the overall discharge grate component.

10. A discharge grate component in accordance with claim 8 wherein the at least one stop is oriented so that there is generally no straight line of path through the discharge openings.

11. A discharge grate component in accordance with claim 8 wherein the at least one said stop has an upstream surface that has a concave curvature in a direction opposite a direction of material flow over the interior surface.

12. A discharge grate component in accordance with claim 8 wherein the discharge grate component has at least one longitudinal support beam to resist bending and deflection of the overall discharge grate component.

13. A discharge grate component is accordance with claim 9 wherein the discharge openings define at least a portion of the at least one said stop.

14. A discharge grate component in accordance with claim 8 wherein the at least one said stop is generally continuously curved as it extends away from the discharge openings.

15. A discharge grate component for use in a reduction machine, the discharge grate component comprising:

at least one longitudinal grate element, a plurality of transverse grate elements intersecting the at least one said longitudinal grate element to define discharge openings through the grate component, the at least one said longitudinal grate element and the plurality of transverse grate elements having an interior working surface defining a wear surface across which material to be reduced traverses, and at least one stop outward of the interior working surface such that there is generally no straight line of path through the discharge openings.

16. A discharge grate component in accordance with claim 15 wherein the at least one said stop extends outward of the discharge openings and has an upstream surface that is arcuate as the upstream surface extends away from the discharge openings such that the upstream surface curves in a direction opposite a direction of material flow over the interior working surface.

17. A discharge grate component in accordance with claim 15 wherein the discharge grate component has at least one longitudinal support beam to resist bending and deflection of the overall discharge grate component.

18. A discharge grate component is accordance with claim 15 wherein the discharge openings define at least a portion of the at least one said stop.

19. A discharge grate component in accordance with claim 15 wherein the at least one said stop is generally continuously curved as it extends away from the discharge openings.

20. A discharge grate component for use in a reduction machine, the discharge grate component comprising at least one longitudinal grate element, a plurality of transverse grate elements intersecting the at least one said longitudinal grate element to define discharge openings through the grate component, the at least one said longitudinal grate element and the plurality of transverse grate elements having an interior working surface defining a wear surface across which material to be reduced traverses, and at least one stop extending outward of the discharge openings and having an upstream surface that is arcuate as the upstream surface extends away from the discharge openings such that the upstream surface curves in a direction opposite a direction of material flow over the interior working surface.

21. A discharge grate component in accordance with claim 20 wherein the discharge grate component has at least one longitudinal support beam to resist bending and deflection of the overall discharge grate component.

22. A discharge grate component in accordance with claim 20 wherein the discharge grate component has at least one longitudinal support beam to resist bending and deflection of the overall discharge grate component, and the at least one longitudinal support beam is secured to the at least one said longitudinal grate element.

23. A discharge grate component in accordance with claim 20 wherein the discharge grate component has at least one longitudinal support beam to resist bending and deflection of the overall discharge grate component, and the at least one said longitudinal support beam is secured to a portion of each of the plurality of transverse grate elements.

24. A discharge grate component in accordance with claim 22 wherein the at least one said longitudinal support beam defines at least a portion of the at least one said stop.

25. A discharge grate component in accordance with claim 20 wherein the at least one said stop is an integral part of the at least one said longitudinal grate element.

26. A discharge grate component in accordance with claim 22 wherein the at least one said stop is an integral part of the at least one said longitudinal grate element and the at least one said longitudinal support beam.

27. A discharge grate component in accordance with claim 22 wherein the at least one said longitudinal support beam extends forward of a leading edge of the interior working surface of the discharge grate component.

28. A discharge grate component is accordance with claim 20 wherein the discharge openings define at least a portion of the at least one said stop.

29. A discharge grate component in accordance with claim 20 wherein the at least one said stop is generally continuously curved as it extends away from the discharge openings.

30. A discharge grate component in accordance with claim 20 wherein the discharge openings have a width in the direction of the material flow over the grate, and the at least one said stop has a depth that it extends outward of the discharge openings, wherein the width of the discharge openings to the depth of the at least one said stop has a ratio of less than 0.95.

31. A discharge grate component in accordance with claim 30 wherein the width to depth ratio is less than or equal to 0.6.

32. A material reducing machine, the material reducing machine comprising, a reducing chamber;

a material inlet system for feeding material into the reducing chamber;

a rotary head having a drive shaft and hammers to reduce the material fed into the reducing chamber; and a grate structure, the grate structure comprising at least one discharge grate component, the discharge grate component comprising intersecting members engaging each other to define a common interior working surface with discharge openings, and at least one stop outward of the common interior working surface and the discharge openings along one of the intersecting members such that a substantial portion of the at least one said stop extends upstream from the one intersecting member to limit the length of material through at least some of the discharge openings.

33. A material reducing machine, the material reducing machine comprising, a reducing chamber;

a material inlet system for feeding material into the reducing chamber;

a rotary head having a drive shaft and hammers to reduce the material fed into the reducing chamber; and a grate structure, the grate structure comprising at least one discharge grate component, the discharge grate component comprising intersecting members to define discharge openings, and at least one support beam to resist bending and deflection of the overall discharge grate component, wherein the at least one support beam extends outward of the discharge openings and is at least partially curved over at least some of the discharge openings to limit the length of material therethrough.

34. A material reducing machine, the material reducing machine comprising, a reducing chamber;

a material inlet system for feeding material into the reducing chamber;

a rotary head having a drive shaft and hammers to reduce the material fed into the reducing chamber; and a grate structure, the grate structure comprising at least one discharge grate component, the discharge grate component comprising at least one longitudinal grate element, a plurality of transverse grate elements intersecting the at least one said longitudinal grate element to define discharge openings through the grate component, the at least one said longitudinal grate element and the plurality of transverse grate elements having an interior working surface defining a wear surface across which material to be reduced traverses, and at least one stop outward of the wear surface such that there is generally no straight line of path through the discharge openings.

35. A material reducing machine, the material reducing machine comprising, a reducing chamber;

a material inlet system for feeding material into the reducing chamber;

a rotary head having a drive shaft and hammers to reduce the material fed into the reducing chamber; and a grate structure, the grate structure comprising at least one discharge grate component, the discharge grate component comprising at least one longitudinal grate element, a plurality of transverse grate elements intersecting the at least one said longitudinal grate element to define discharge openings through the grate component, the at least one said longitudinal grate element and the plurality of transverse grate elements having an interior working surface defining a wear surface across which material to be reduced traverses, and at least one stop extending outward of the discharge openings and having an upstream surface that is arcuate as the upstream surface extends away from the discharge openings such that the upstream surface curves in a direction opposite a direction of material flow over the interior working surface.

36. A material reducing machine, the material reducing machine comprising, a reducing chamber;

a material inlet system for feeding material into the reducing chamber;

a rotary head having a drive shaft and hammers to reduce the material fed into the reducing chamber, the rotary head having a rotational axis about which it rotates; and a grate structure, the grate structure comprising a plurality of discharge grate components, each said discharge grate component comprising at least one longitudinal grate element, a plurality of transverse grate elements intersecting the at least one said longitudinal grate element to define discharge openings through the grate component, the at least one said longitudinal grate element and the plurality of transverse grate elements having an interior working surface defining a wear surface across which material to be reduced traverses, and at least one stop extending outward of the discharge openings and having an upstream surface that is arcuate as the upstream surface extends away from the discharge openings such that the upstream surface curves in a direction opposite a direction of material flow over the interior working surface wherein the plurality of discharge grate components are installed in the grate structure in a position between approximately 30 degrees and 180 degrees relative to the rotational axis of the rotary head.

* * * * *